US009084314B2

(12) United States Patent
Conover et al.

(10) Patent No.: US 9,084,314 B2
(45) Date of Patent: Jul. 14, 2015

(54) PROGRAMMABLE UNDERWATER LIGHTING SYSTEM

(75) Inventors: Gilbert Conover, Providence, RI (US); Kevin L. Potucek, Far Hills, NJ (US); Lloyd Slonim, Providence, RI (US); Carl L. Brunetti, Manville, RI (US); Joseph Gonsalves, Warren, RI (US); Paul Canavan, Mountain Lakes, NJ (US)

(73) Assignee: Hayward Industries, Inc., Elizabeth, NJ (US)

( * ) Notice: Subject to any disclaimer, the term of this patent is extended or adjusted under 35 U.S.C. 154(b) by 530 days.

(21) Appl. No.: 11/946,685

(22) Filed: Nov. 28, 2007

(65) Prior Publication Data

US 2008/0197788 A1 Aug. 21, 2008

Related U.S. Application Data

(60) Provisional application No. 60/861,607, filed on Nov. 28, 2006.

(51) Int. Cl.
*H05B 37/02* (2006.01)

(52) U.S. Cl.
CPC ..... *H05B 37/029* (2013.01)

(58) Field of Classification Search
USPC ..... 315/291, 307, 308, 309, 312, 299, 315/316–318; 362/800, 559, 276
See application file for complete search history.

(56) References Cited

U.S. PATENT DOCUMENTS 1,874,513 A 8/1932 Hall
1,991,775 A 2/1935 Spencer (Continued)

FOREIGN PATENT DOCUMENTS

EP 1 016 062 8/2002
GB 2 239 306 6/1991

(Continued)

OTHER PUBLICATIONS

IntelliBrite™ Underwater Color-Changing Lights (2007) (4 pages).

(Continued)

*Primary Examiner* — Douglas W Owens
*Assistant Examiner* — Jonathan Cooper
(74) *Attorney, Agent, or Firm* — McCarter & English, LLP

(57) ABSTRACT

The present disclosure relates to a programmable underwater lighting system for pools and spas. A plurality of underwater lights, each having a plurality of LEDs for producing light of various colors, a microprocessor for controlling the plurality of LEDs, and a memory in communication with the microprocessor containing one or more stored control programs, allow for the generation of various lighting effects in a pool or spa. A central controller is provided in communication with the plurality of underwater lights, and allows a user to define or select a desired lighting effect (such as a sequence, a fading effect, a "moving" color pattern, etc.) using a display and a keyboard. Optionally, a handheld remote control could be provided, in wireless communication with the central controller, for allowing a user to remotely control the plurality of lighting fixtures. When a desired lighting effect is defined by a user, the central controller transmits an instruction to each of the plurality of underwater lights instructing each light to execute a specific stored control program in its memory to produce the desired lighting effect. Each of the lights could be in communication with the central controller using a power line and an associated power line carrier data protocol, and each light could be provided with a thermal management system for monitoring the operating temperature of the light and automatically adjusting the brightness of the light to prevent dangerous temperatures.

25 Claims, 38 Drawing Sheets

(56) References Cited

U.S. PATENT DOCUMENTS 2,057,186 A 10/1936 Freeberg
2,323,793 A 7/1943 Clark
2,355,607 A 8/1944 Shepherd
2,881,409 A 4/1959 Cook
2,903,674 A 9/1959 Schwab
3,020,522 A 2/1962 Lesher
3,114,127 A 12/1963 Ramsey
3,213,377 A 10/1965 Neale
3,255,433 A 6/1966 Lesher
3,257,641 A 6/1966 Campana et al.
3,271,734 A 9/1966 Cabe et al.
3,435,213 A 3/1969 Colbow et al.
3,594,720 A 7/1971 Cane
3,804,049 A 4/1974 Greer
4,053,758 A 10/1977 Shaw
4,135,144 A 1/1979 Elmasian
4,298,868 A 11/1981 Spurgeon
4,392,187 A 7/1983 Bornhorst
4,636,036 A 1/1987 Pasquali
4,814,800 A 3/1989 Lavinsky et al.
4,890,208 A 12/1989 Izenour
4,974,133 A 11/1990 Fujiki
5,045,983 A 9/1991 Shields
5,220,464 A 6/1993 Lin
5,256,948 A 10/1993 Boldin et al.
5,649,242 A 7/1997 O'Brien et al.
5,842,771 A 12/1998 Thrasher et al.
5,893,626 A 4/1999 Poling
6,002,216 A 12/1999 Mateescu
6,016,038 A 1/2000 Mueller et al.
6,081,191 A 6/2000 Green et al.
RE36,790 E 7/2000 Jincks et al.
6,090,484 A 7/2000 Bergerson
6,100,791 A 8/2000 Bader et al.
6,152,577 A 11/2000 Rizkin et al.
6,166,496 A 12/2000 Lys et al.
6,175,354 B1 1/2001 Blissett et al.
6,184,628 B1 2/2001 Ruthenberg
6,196,471 B1 3/2001 Ruthenberg
6,211,626 B1 4/2001 Lys et al.
6,241,361 B1 6/2001 Thrasher et al.
6,241,362 B1 6/2001 Morrison
6,292,901 B1 9/2001 Lys et al.
6,351,079 B1 * 2/2002 Willis ..... 315/291
6,357,889 B1 3/2002 Duggal et al.
6,367,541 B2 4/2002 McCullough
6,379,025 B1 4/2002 Mateescu et al.
6,435,691 B1 8/2002 Macey et al.
6,459,919 B1 10/2002 Lys et al.
6,528,954 B1 3/2003 Lys et al.
6,548,967 B1 4/2003 Dowling et al.
6,554,454 B1 4/2003 Kitano et al.
6,570,493 B1 5/2003 Rotem
6,577,080 B2 6/2003 Lys et al.
6,585,399 B2 7/2003 Kreutzer et al.
6,608,453 B2 8/2003 Morgan et al.
6,616,291 B1 9/2003 Love et al.
6,622,053 B1 9/2003 Hewlett et al.
6,624,597 B2 9/2003 Dowling et al.
6,717,376 B2 4/2004 Lys et al.
6,720,745 B2 4/2004 Lys et al.
6,744,223 B2 6/2004 Laflamme et al.
6,774,584 B2 8/2004 Lys et al.
6,777,891 B2 8/2004 Lys et al.
6,781,329 B2 8/2004 Mueller et al.
6,801,003 B2 10/2004 Schanberger et al.
6,811,286 B2 11/2004 Mateescu et al.
6,831,679 B1 12/2004 Olsson et al.
6,869,204 B2 3/2005 Morgan et al.
6,883,929 B2 4/2005 Dowling
6,886,625 B1 5/2005 Sagal et al.
6,888,322 B2 5/2005 Dowling et al.
6,896,045 B2 5/2005 Panek
6,897,624 B2 5/2005 Lys et al.
6,936,978 B2 8/2005 Morgan et al.
6,965,205 B2 11/2005 Piepgras et al.
6,967,448 B2 11/2005 Morgan et al.
6,969,954 B2 11/2005 Lys
6,971,760 B2 12/2005 Archer et al.
6,975,079 B2 12/2005 Lys et al.
6,981,805 B2 1/2006 Miller et al.
7,023,147 B2 4/2006 Colby et al.
7,031,920 B2 4/2006 Dowling et al.
7,038,398 B1 5/2006 Lys et al.
7,038,399 B2 5/2006 Lys et al.
7,055,988 B2 6/2006 Mateescu et al.
7,064,498 B2 6/2006 Dowling et al.
7,097,329 B2 8/2006 Mateescu et al.
7,113,541 B1 9/2006 Lys et al.
7,128,440 B2 10/2006 Mateescu et al.
7,132,635 B2 11/2006 Dowling
7,132,785 B2 11/2006 Ducharme
7,135,824 B2 11/2006 Lys et al.
7,139,617 B1 11/2006 Morgan et al.
7,161,311 B2 1/2007 Mueller et al.
7,161,556 B2 1/2007 Morgan et al.
7,178,941 B2 2/2007 Roberge et al.
7,180,252 B2 * 2/2007 Lys et al. ..... 315/312
7,186,003 B2 3/2007 Dowling et al.
7,202,613 B2 4/2007 Morgan et al.
7,204,602 B2 4/2007 Archer
7,204,622 B2 4/2007 Dowling et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,248,239 B2 7/2007 Dowling et al.
7,253,566 B2 8/2007 Lys et al.
7,255,457 B2 8/2007 Ducharme et al.
7,256,554 B2 8/2007 Lys et al.
7,258,463 B2 8/2007 Sloan et al.
7,278,762 B2 10/2007 Schottland et al.
7,300,192 B2 11/2007 Mueller et al.
7,303,300 B2 12/2007 Dowling et al.
7,303,301 B2 12/2007 Koren et al.
7,309,965 B2 12/2007 Dowling et al.
7,352,339 B2 4/2008 Morgan et al.
7,353,071 B2 4/2008 Blackwell et al.
7,357,525 B2 4/2008 Doyle
7,358,679 B2 4/2008 Lys et al.
7,358,706 B2 4/2008 Lys
7,358,929 B2 4/2008 Mueller et al.
7,364,488 B2 4/2008 Mueller et al.
7,396,139 B2 7/2008 Savage
7,410,268 B2 8/2008 Koren et al.
7,449,847 B2 11/2008 Schanberger et al.
7,482,764 B2 1/2009 Morgan et al.
7,488,084 B2 2/2009 Potucek et al.
7,497,595 B2 3/2009 Mateescu et al.
7,514,884 B2 4/2009 Potucek et al.
7,520,628 B1 4/2009 Sloan et al.
7,521,872 B2 * 4/2009 Bruning ..... 315/312
7,550,935 B2 6/2009 Lys et al.
7,553,040 B2 6/2009 Boothe et al.
7,598,681 B2 10/2009 Lys et al.
7,628,512 B2 12/2009 Netzel, Sr. et al.
7,705,240 B2 4/2010 Armstrong et al.
7,722,216 B2 5/2010 Amor et al.
7,845,823 B2 * 12/2010 Mueller et al. ..... 315/312
7,847,486 B2 * 12/2010 Ng ..... 315/119
2002/0043938 A1 4/2002 Lys
2002/0065583 A1 * 5/2002 Okada et al. ..... 700/295
2002/0074559 A1 6/2002 Dowling et al.
2002/0113555 A1 8/2002 Lys et al.
2002/0130627 A1 9/2002 Morgan et al.
2002/0149933 A1 10/2002 Archer et al.
2002/0152045 A1 10/2002 Dowling et al.
2002/0163316 A1 * 11/2002 Lys et al. ..... 315/291
2002/0171377 A1 * 11/2002 Mueller et al. ..... 315/291
2002/0176259 A1 11/2002 Ducharme et al.
2003/0048632 A1 3/2003 Archer
2003/0057884 A1 3/2003 Dowling et al.
2003/0133292 A1 7/2003 Mueller et al.

(56) References Cited

U.S. PATENT DOCUMENTS

| | | | |
|---|---|---|---|
| 2004/0047145 | A1 | 3/2004 | Koren |
| 2004/0052076 | A1 | 3/2004 | Mueller et al. |
| 2004/0085754 | A1 | 5/2004 | Koren et al. |
| 2004/0105261 | A1 | 6/2004 | Ducharme et al. |
| 2004/0141321 | A1 | 7/2004 | Dowling et al. |
| 2004/0208008 | A1 | 10/2004 | Mateescu et al. |
| 2004/0223320 | A1 | 11/2004 | Archer et al. |
| 2005/0040774 | A1 | 2/2005 | Mueller et al. |
| 2005/0041161 | A1 | 2/2005 | Dowling et al. |
| 2005/0047134 | A1 | 3/2005 | Mueller et al. |
| 2005/0047772 | A1 | 3/2005 | Hayami et al. |
| 2005/0088119 | A1 | 4/2005 | Potucek et al. |
| 2005/0088434 | A1 | 4/2005 | Potucek |
| 2005/0099824 | A1 | 5/2005 | Dowling et al. |
| 2005/0116665 | A1 | 6/2005 | Colby et al. |
| 2005/0128751 | A1 | 6/2005 | Roberge et al. |
| 2005/0168970 | A1 | 8/2005 | Mateescu et al. |
| 2005/0174473 | A1 | 8/2005 | Morgan et al. |
| 2005/0213352 | A1 | 9/2005 | Lys |
| 2005/0213353 | A1 | 9/2005 | Lys |
| 2005/0218870 | A1 | 10/2005 | Lys |
| 2005/0248299 | A1 | 11/2005 | Chemel et al. |
| 2005/0276044 | A1 | 12/2005 | Mateescu et al. |
| 2006/0012987 | A9 | 1/2006 | Ducharme et al. |
| 2006/0022214 | A1 | 2/2006 | Morgan et al. |
| 2006/0023454 | A1 | 2/2006 | Koren |
| 2006/0038661 | A1 | 2/2006 | Reinhold et al. |
| 2006/0076908 | A1* | 4/2006 | Morgan et al. ..... 315/312 |
| 2006/0092636 | A1 | 5/2006 | Potucek et al. |
| 2006/0198128 | A1 | 9/2006 | Piepgras et al. |
| 2006/0238130 | A1* | 10/2006 | Hosoya ..... 315/86 |
| 2006/0291213 | A1 | 12/2006 | Mateescu et al. |
| 2007/0096134 | A1 | 5/2007 | Kim et al. |
| 2007/0097667 | A1 | 5/2007 | Armstrong et al. |
| 2007/0097675 | A1 | 5/2007 | Koren et al. |
| 2007/0159833 | A1 | 7/2007 | Netzel, Sr. et al. |
| 2007/0263378 | A1 | 11/2007 | Koren |
| 2008/0112157 | A1 | 5/2008 | Boothe et al. |
| 2008/0165547 | A1 | 7/2008 | Amor et al. |
| 2008/0297068 | A1 | 12/2008 | Koren et al. |
| 2009/0013570 | A1 | 1/2009 | Grajcar |
| 2009/0109617 | A1 | 4/2009 | Grajcar |
| 2009/0180281 | A1 | 7/2009 | Ahland, III et al. |
| 2009/0180290 | A1 | 7/2009 | Grajcar |
| 2009/0185350 | A1 | 7/2009 | Grajcar |
| 2009/0185373 | A1 | 7/2009 | Grajcar |
| 2009/0204239 | A1 | 8/2009 | Netzel, Sr. et al. |
| 2009/0278479 | A1 | 11/2009 | Platner et al. |
| 2010/0118511 | A1 | 5/2010 | Wegat |
| 2010/0157599 | A1 | 6/2010 | Carter et al. |
| 2011/0001436 | A1 | 1/2011 | Chemel et al. |

FOREIGN PATENT DOCUMENTS

| | | |
|---|---|---|
| WO | WO 99/31560 | 6/1999 |
| WO | WO 00/01067 | 1/2000 |
| WO | WO 01/05195 | 1/2001 |
| WO | WO 01/24584 | 4/2001 |
| WO | WO 01/36864 | 5/2001 |
| WO | WO 01/82657 | 11/2001 |
| WO | WO 01/99475 | 12/2001 |
| WO | WO 02/10847 | 2/2002 |
| WO | WO 02/11497 | 2/2002 |
| WO | WO 02/12127 | 2/2002 |
| WO | WO 02/13490 | 2/2002 |
| WO | WO 02/18913 | 3/2002 |
| WO | WO 02/25842 | 3/2002 |
| WO | WO 02/40921 | 5/2002 |
| WO | WO 02/45467 | 6/2002 |
| WO | WO 02/061330 | 8/2002 |
| WO | WO 02/069306 | 9/2002 |
| WO | WO 02/091805 | 11/2002 |
| WO | WO 02/098182 | 12/2002 |
| WO | WO 02/098183 | 12/2002 |
| WO | WO 02/099780 | 12/2002 |
| WO | WO 02/101702 | 12/2002 |
| WO | WO 03/024269 | 3/2003 |
| WO | WO 03/026358 | 3/2003 |
| WO | WO 03/055273 | 7/2003 |
| WO | WO 03/067934 | 8/2003 |
| WO | WO 03/096761 | 11/2003 |
| WO | WO 2004/021747 | 3/2004 |
| WO | WO 2004/023850 | 3/2004 |
| WO | WO 2004/032572 | 4/2004 |
| WO | WO 2004/094896 | 11/2004 |
| WO | WO 2004/100624 | 11/2004 |
| WO | WO 2005/012997 | 2/2005 |
| WO | WO2005/024898 | 3/2005 |
| WO | WO 2005/060309 | 6/2005 |
| WO | WO 2005/084339 | 9/2005 |
| WO | WO 2005/089293 | 9/2005 |
| WO | WO 2005/089309 | 9/2005 |
| WO | WO 2006/023149 | 3/2006 |
| WO | WO 2006/031753 | 3/2006 |
| WO | WO 2006/031810 | 3/2006 |
| WO | WO 2008/067402 | 6/2008 |

OTHER PUBLICATIONS

Underwater ColorLogic™ LED Lighting Fixtures SP0525(S) Owner's Manual (2004) (12 pages).

Underwater ColorLogic™ LED Lighting Fixtures SP0523(S) Owner's Manual (2004) (12 pages).

U.S. Appl. No. 60/515,090 entitled "Color Changing Image with Backlighting and Combination Localized Gray-Scale and Color Image" filed Oct. 28, 2003, Inventors: Kevin Potucek and Kevin Murphy (13 pages).

U.S. Appl. No. 60/071,281 entitled "Digitally Controlled Light Emitting Diode Systems and Methods" filed Dec. 17, 1997, Inventors: George G. Mueller and Ihor A. Lys (24 pages).

U.S. Appl. No. 60/243,250 entitled "Illumination of Liquids" filed Oct. 25, 2000, Inventors: Frederick Morgan, Timothy Holmes, Chris Cantone, Ihor Lys and George Mueller (24 pages).

U.S. Appl. No. 60/297,828 entitled "Systems and Methods for Controlling Lighting Systems" filed Jun. 13, 2001, Inventors: George Mueller, Frederick Morgan, Ihor Lys and Kevin Dowling (13 pages).

U.S. Appl. No. 60/296,377 entitled "Systems and Methods for Controlling Lighting Systems" filed Jun. 6, 2001, Inventors: Mike Blackwell (11 pages).

U.S. Appl. No. 60/290,101 entitled "Systems and Methods for Synchronizing Illumination Systems" filed May 10, 2001, Inventors: Kevin Dowling and Eric K. Schanberger (27 pages).

U.S. Appl. No. 60/090,920 entitled "Method for Software Driven Generation of Multiple Simultaneous High Speed Pulse Width Modulated Signals" filed Jun. 26, 1998, Inventors: Ihor Lys (8 pages).

U.S. Appl. No. 60/078,861 entitled "Digital Lighting Systems" filed Mar. 20, 1998, Inventors: Ihor Lys (2 pages).

U.S. Appl. No. 60/079,285 entitled "Systems and Methods for Controlled Illumination" filed Mar. 25, 1998, Inventors: George G. Mueller and Ihor Lys (34 pages).

U.S. Appl. No. 60/068,792 entitled "Multi-Color Intelligent Lighting" filed Dec. 24, 1997, Inventors: George G. Mueller and Ihor Lys (2 pages).

U.S. Appl. No. 60/199,333 entitled "Autonomous Color Changing Accessory" filed Apr. 24, 2000, Inventors: Al Ducharme, Ihor Lys and Kevin Dowling (19 pages).

International Search Report of the International Searching Authority mailed Jun. 12, 2008, issued in connection with International Patent Appl. No. PCT/US07/85793 (3 pages).

Written Opinion of the International Searching Authority mailed Jun. 12, 2008, issued in connection with International Patent Appl. No. PCT/US07/85793 (5 pages).

Underwater ColorLogic™ LED Lighting Fixtures SP0524(S), SP0525(S), SP0527(S), SP0532(S), SP0533(S) and SP0535(S) Owner's Manual (2004) (12 pages).

CoolPoly® D5108 Thermally Conductive Polyphenylene Sulfide (PPS), Product Data Sheet dated Aug. 8, 2007 (2 pages).

(56) References Cited

OTHER PUBLICATIONS

American/Pentair Niche w/3/4 in. Side Hub, Concrete (78210400), printed from Internet website http://www.poolplaza.com/P-PEN-78210400-2282. html (Oct. 19, 2010) (1 page).

American/Pentair Niche w/1.0 in. Hub, Vinyl/Fbgls (10 Hole) (78232500), printed from Internet website http://www.poolplaza.com/P-PEN-78210400-2282. html (Oct. 19, 2010) (1 page).

Sta-Rite® Large Underwater Light Niche Owner's Manual (2004) (8 pages).

Product Specifications for Jandy ProNiche Pool and Spa Light Niches, printed from Internet website http://www.jandy.com/html/products/lights/proniche/specs.php (Oct. 19, 2010) (2 pages).

Jandy ProNiche ~ Pool & Spa Light Niches, product description (2007) (2 pages).

Jandy Installation Manual Jandy Housing for Wet Niche Fixtures (2007) (8 pages).

Pentair 620004 AmerLite Quick Niche, printed from Internet website http://www.aqua-man.com/row_num.asp?Ic=1892 (Oct. 19, 2010) (2 pages).

Pentair 79206700 AmerLite Large Plastic Niche, printed from Internet website http://www.aqua-man.com/row_num.asp?Ic=1895 (Oct. 19, 2010) (2 pages).

QuickNiche Vinyl Pool Lighting Niche by Pentair Water Pool and Spa, product description (2006) (2 pages).

Bond-Ply 100—"Thermally Conductive, Fiberglass Reinforced Pressure Sensitive Adhesive Tape," The Bergquist Company, http://www.bergquistcompany.com, publicly available prior to Dec. 24, 2008 (3 pages).

Aqua Logic Automation and Chlorination Operation Manual (2004) (40 pages).

U.S. Appl. No. 12/769,038 entitled: "Underwater Light Having a Sealed Polymer Housing and Method of Manufacture Therefor," filed Apr. 28, 2010 (46 pages).

Supplementary European Search Report dated Jan. 27, 2014, issued in connection with European Patent Appln. No. 07871628 (7 pages).

Requisition issued by the Canadian Intellectual Property Office dated Jul. 24, 2014, in connection with Canadian Patent Application No. 2,670,557 (2 pages).

Patent Examination Report No. 1 issued by the Australian Intellectual Property Office dated Jun. 26, 2014, in connection with Australian Patent Application No. 2013270529 (4 pages).

* cited by examiner 1-3: UNDERWATER LUMINAIRES 1-3: UNDERWATER LUMINAIRES

TO POOL LIGHTS
12V POOL TRANSFORMERS
76
74
BREAKERS
BREAKER PANEL
L1
L2
120V
N
120V
PLC COMM BOARD
75
MSP430
77
CHARGE PUMP
RS-485
73
10VDC 50mA
120V
POWER SUPPLY
71
CONTROLLER BOARD
72
CHASSIS
70
UP TO 6 MORE POOL TRANSFORMERS
PLC EXPANSION CARD
70L
70H
72
BREAKERS
74
POOL TRANSFORMER
POOL TRANSFORMER
76
4 POOL LIGHTS
4 POOL LIGHTS
70
73 485 10V
75 COM BOARD
CHASSIS
78 PLC COUPLING

FIG. 8A1
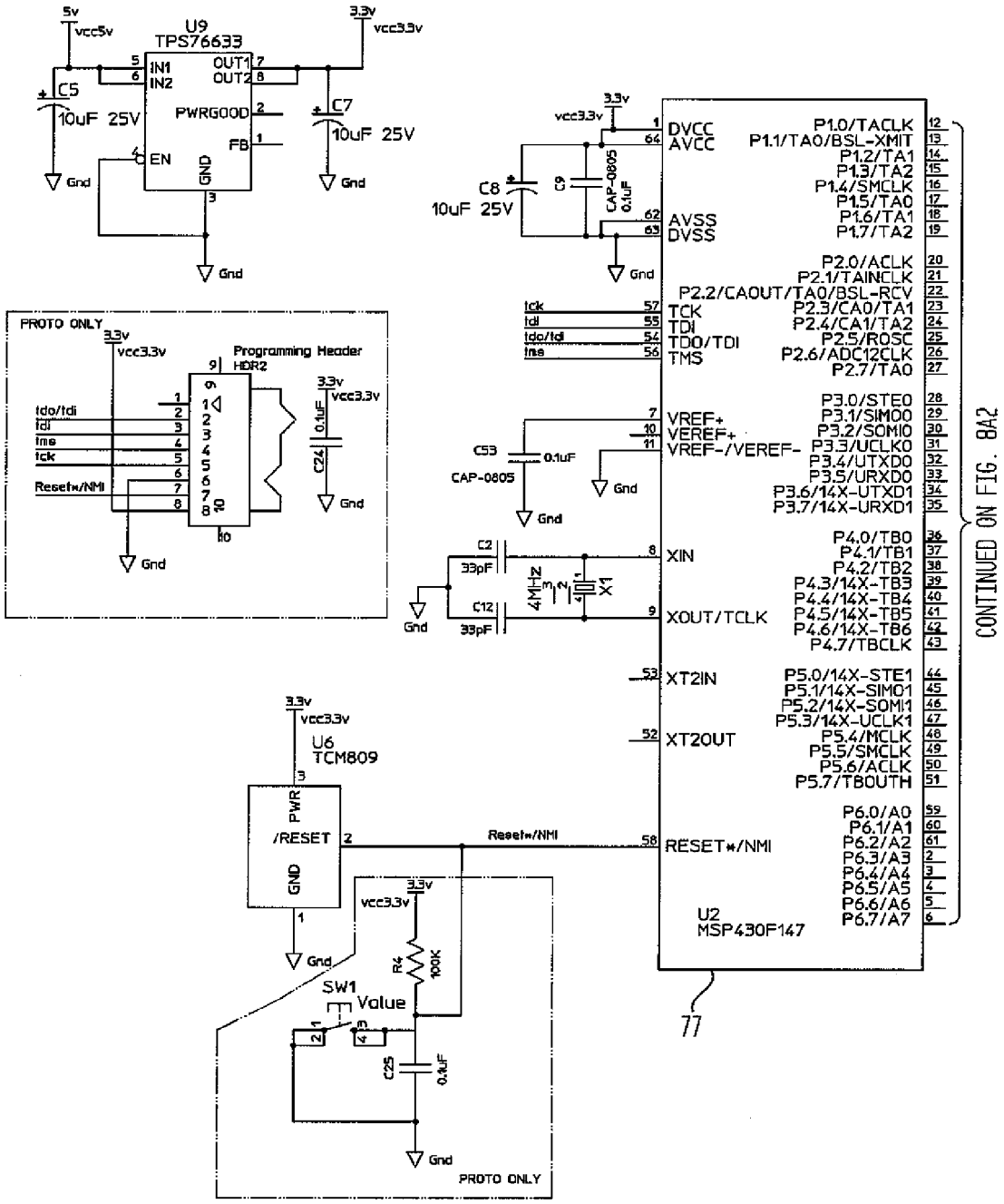

FIG. 8A2
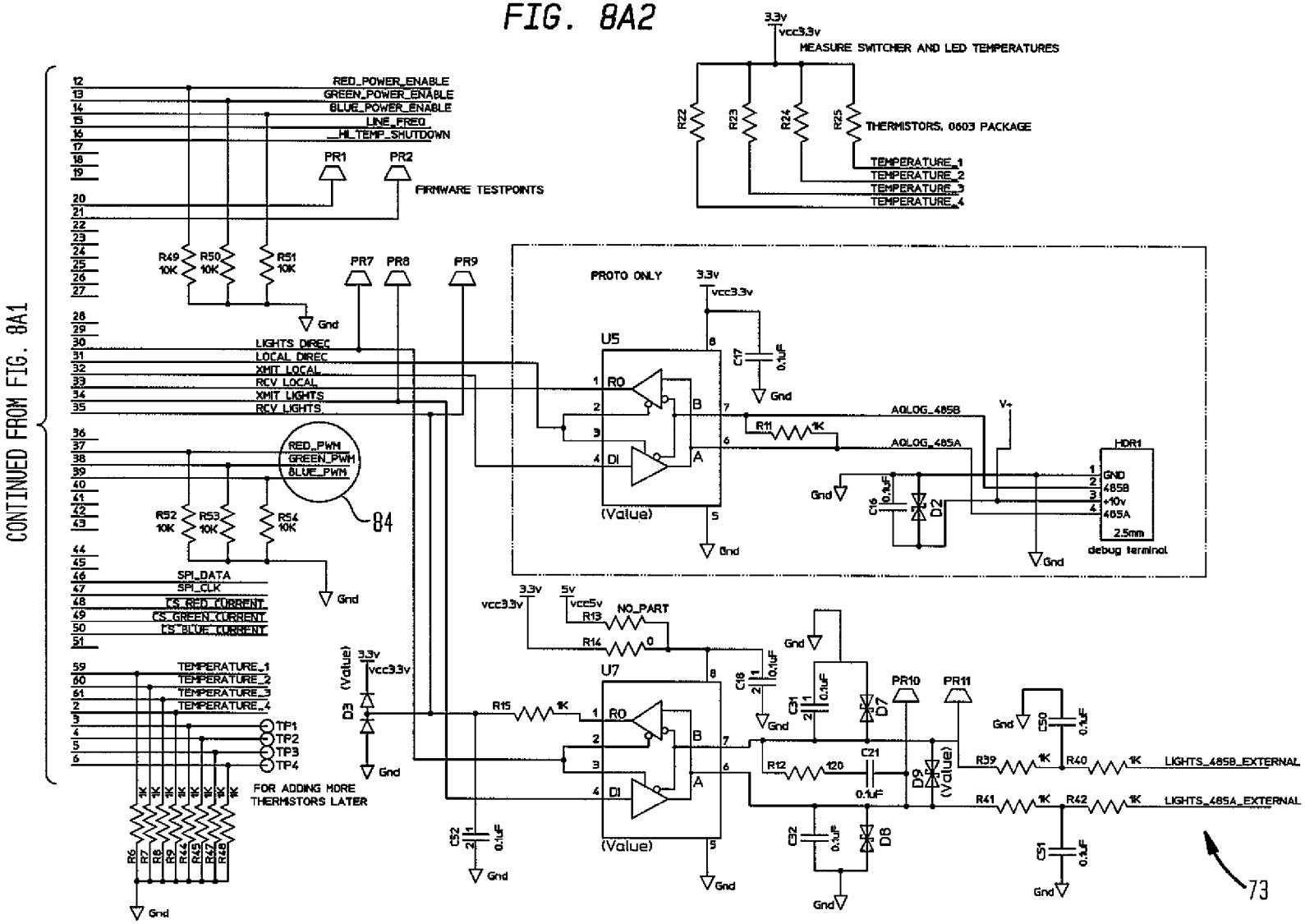

FIG. 8B1
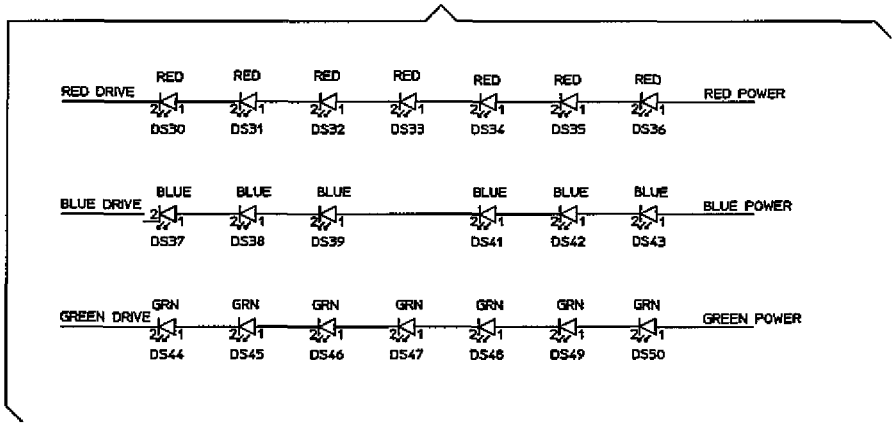
FIG. 8B2
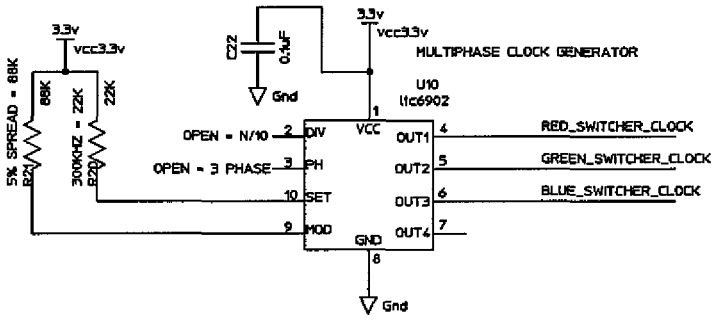
FIG. 8B3
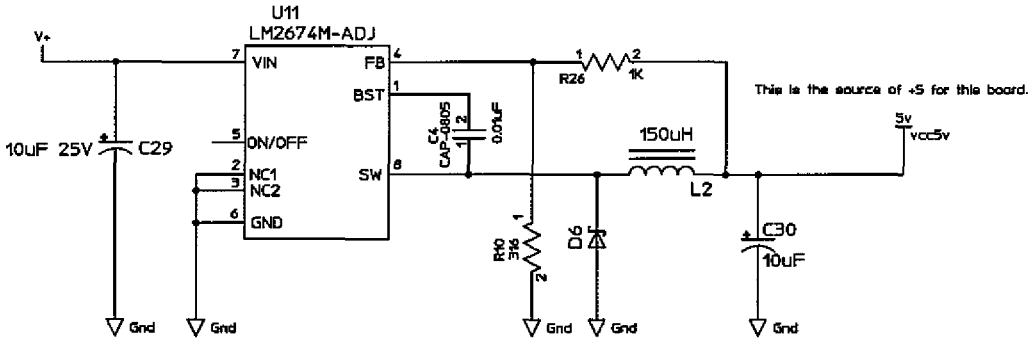

FIG. 8B4
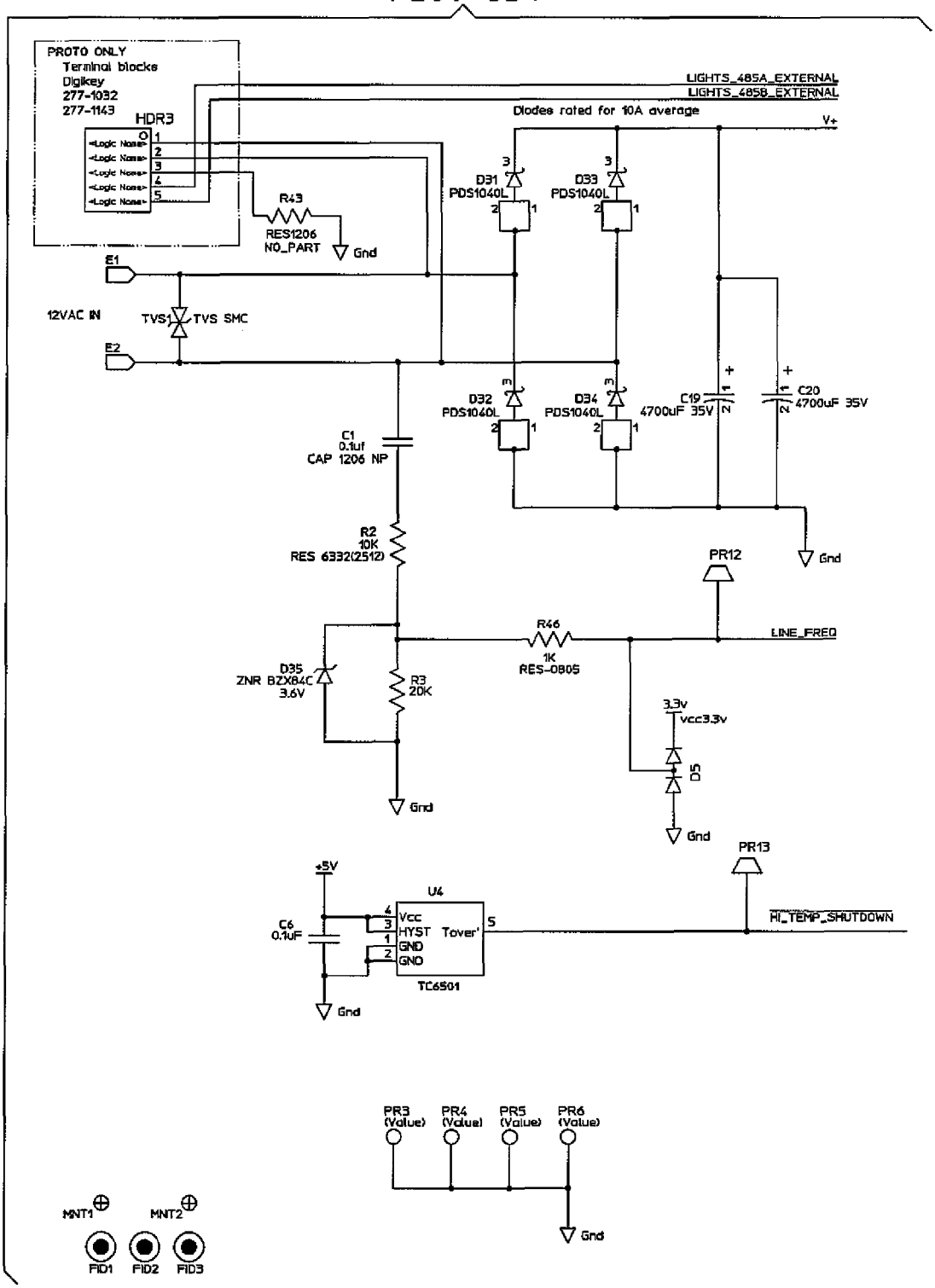

FIG. 10A1
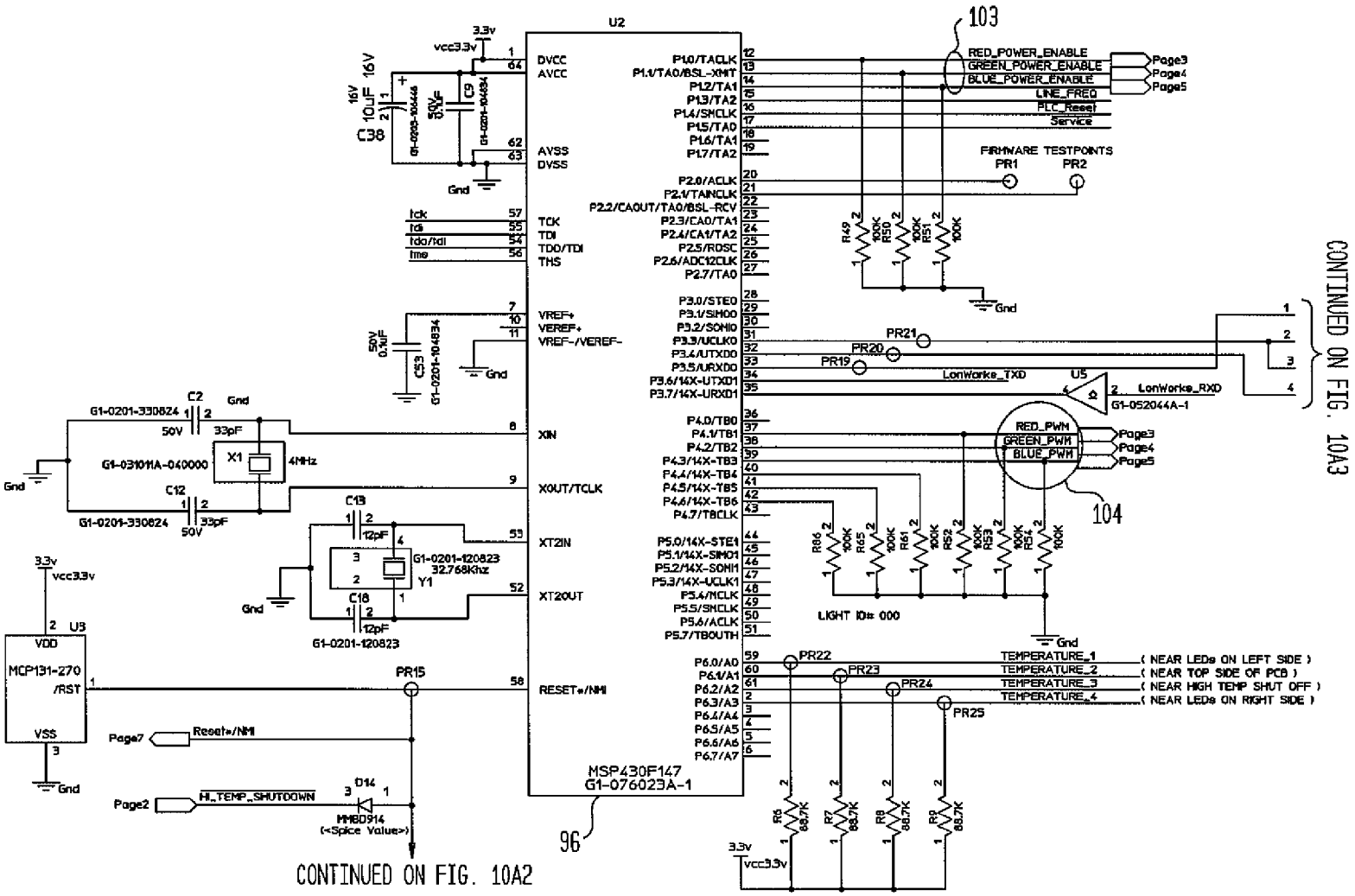

FIG. 10A2
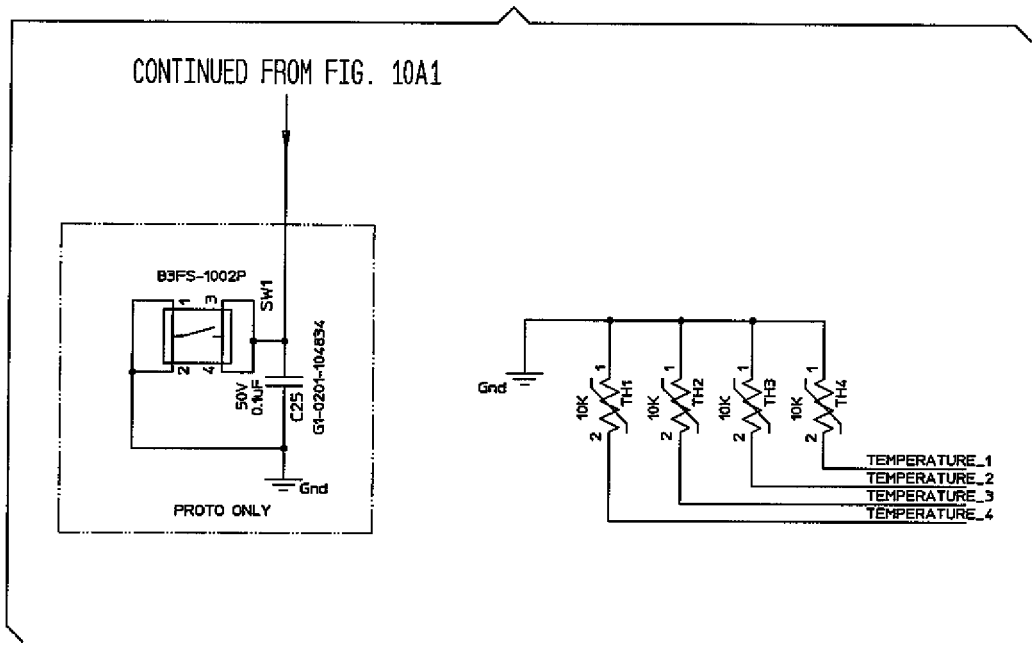

FIG. 10A3
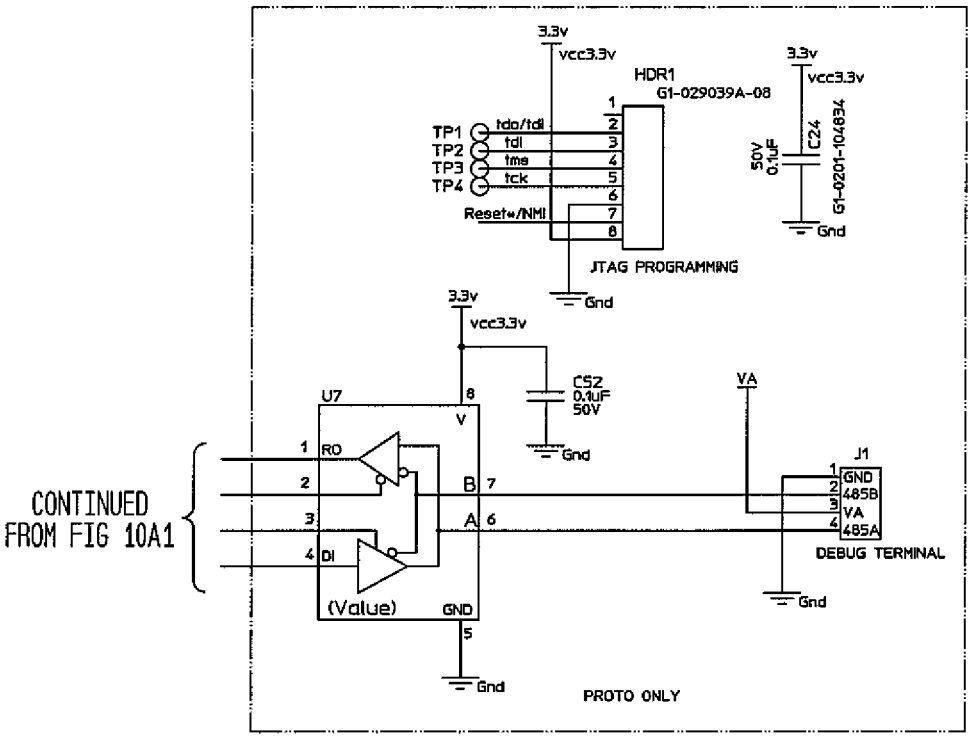
FIG. 10A4
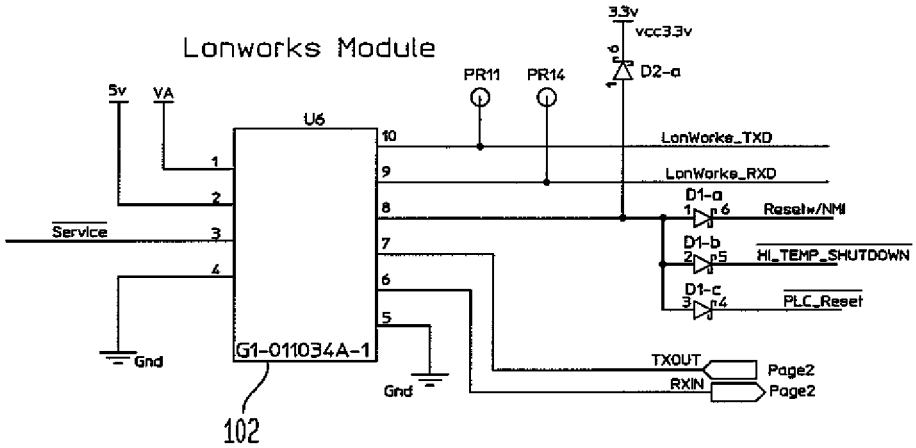

FIG. 10B1
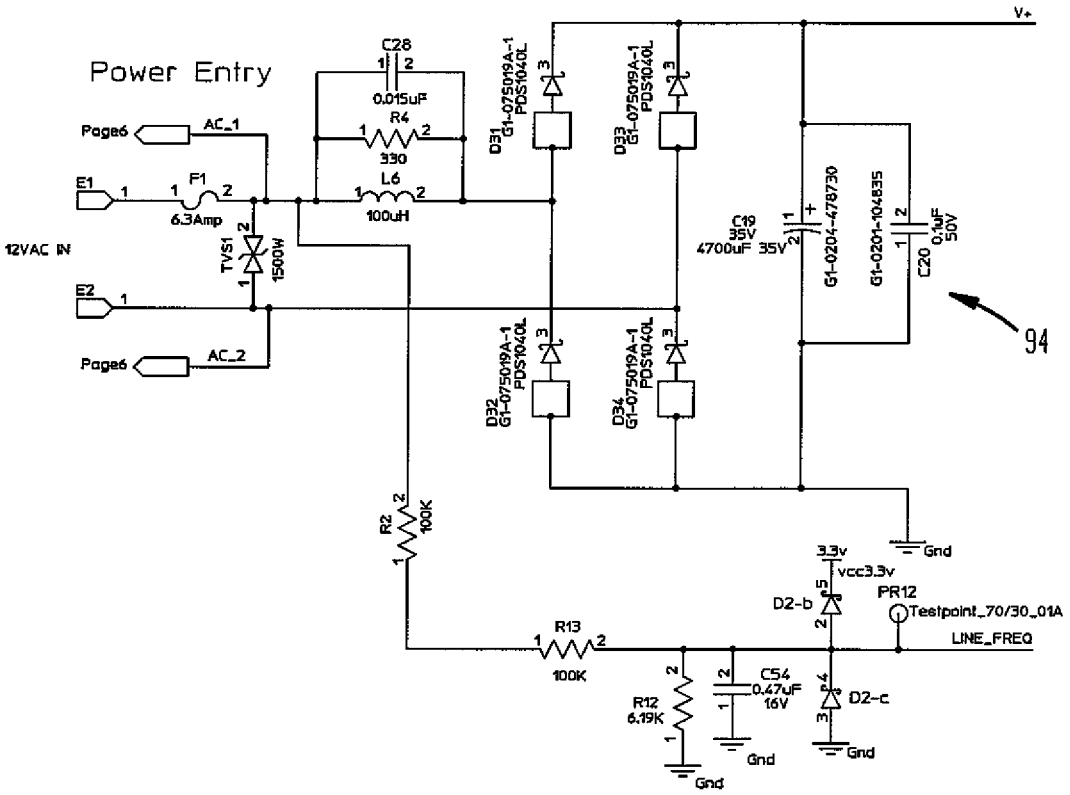
FIG. 10B2
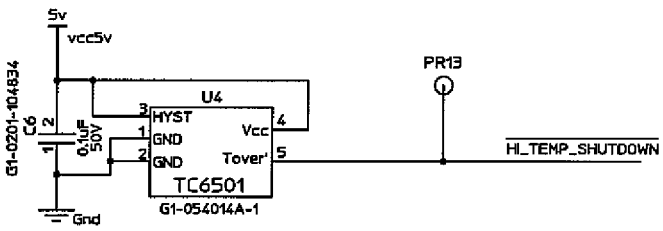
High Temperature failsafe if CPU hangs FIG. 10B3
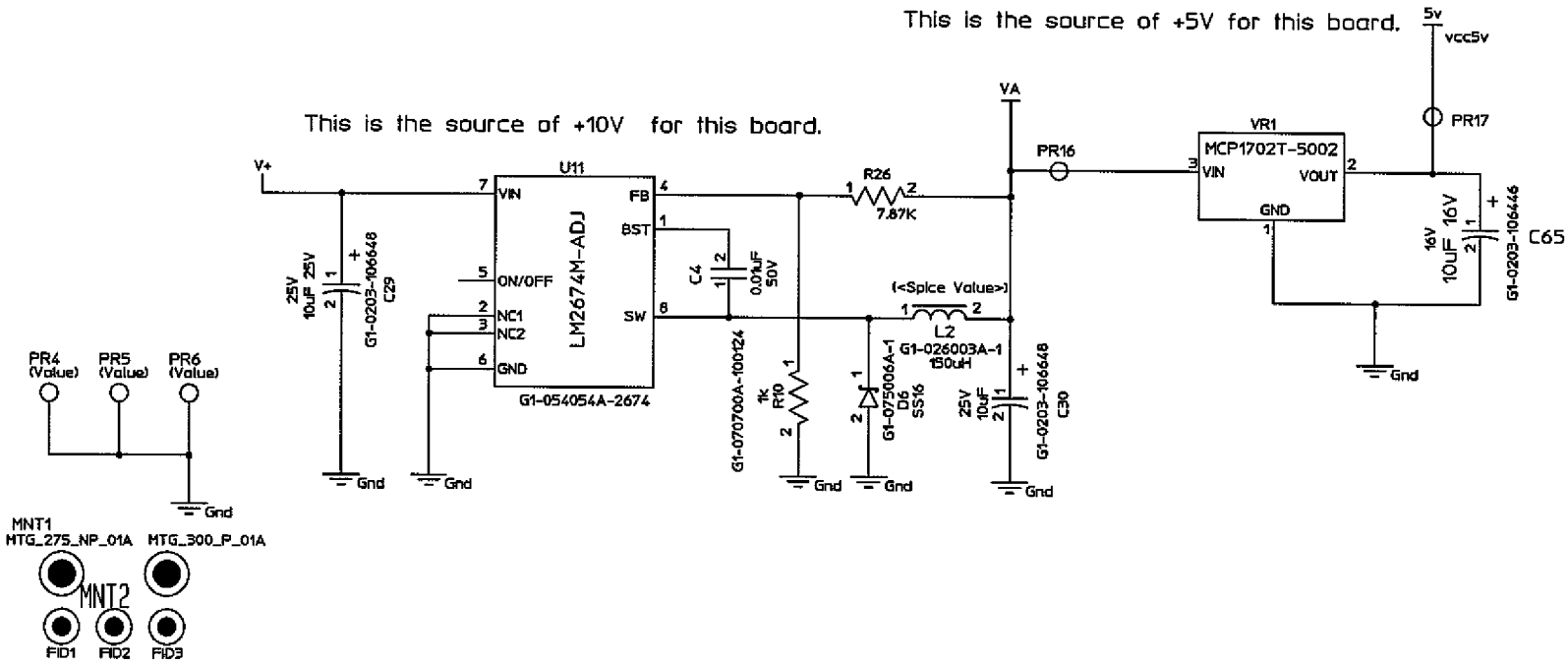

FIG. 10B4
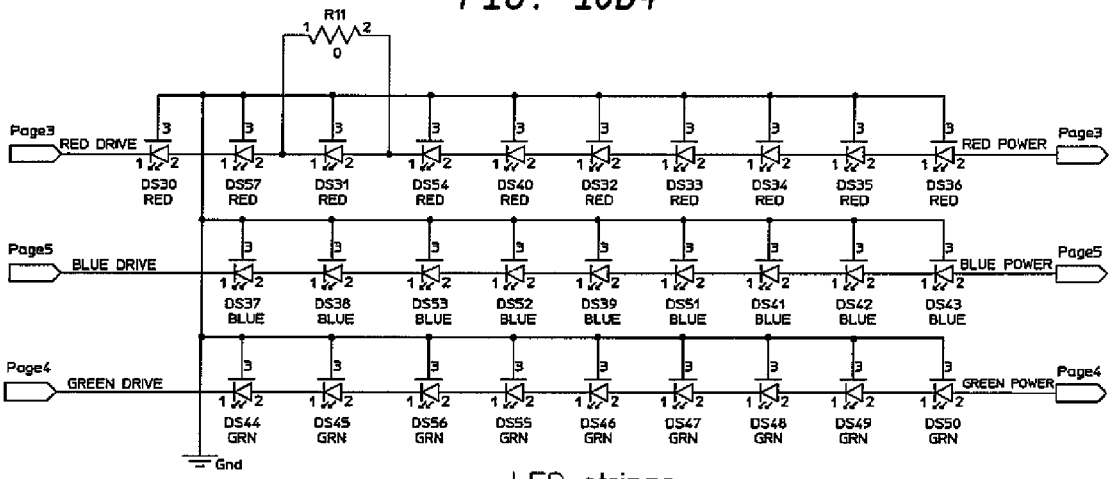
LED strings
FIG. 10B5
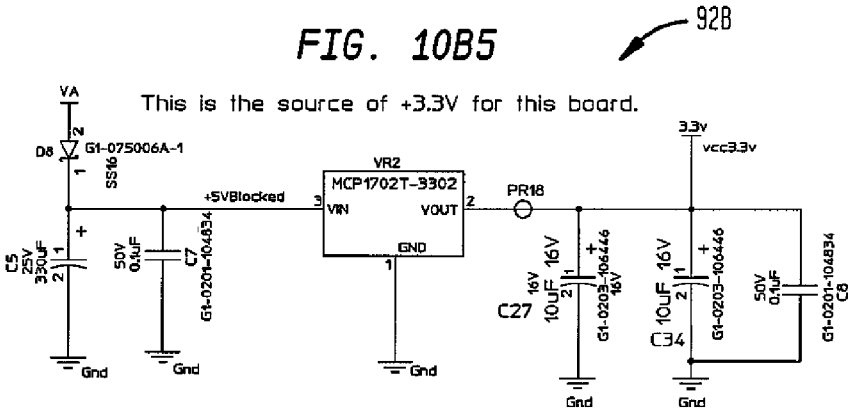
FIG. 10B6
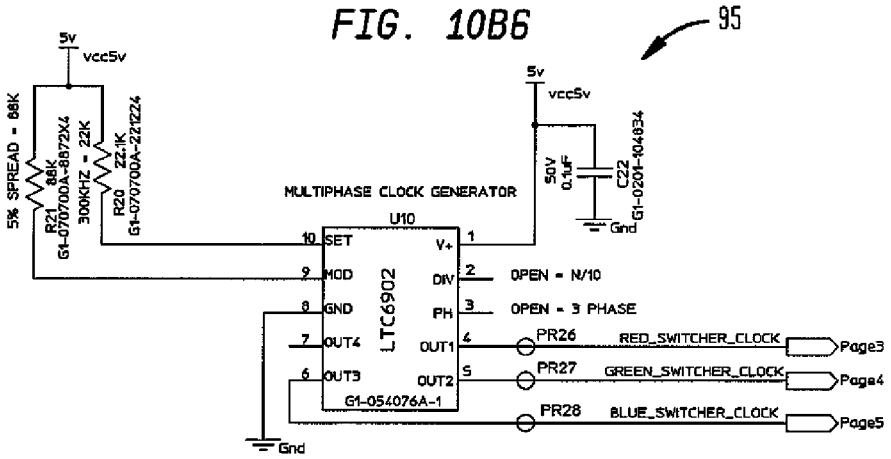
Multi-phase controller, Boost supplies 120
CHASSIS
120V
121
POWER SUPPLY
CONTROLLER BOARD
122
123
RS-485
10VDC 50mA
125
COMM BOARD
127
MSP430
CHARGE PUMP
120V
N
120V
124
L1
L2
BREAKERS
BREAKER PANEL
120V POOL LIGHTS
MORE 120V POOL LIGHTS 120
123 485 10V
125 COM BOARD
CHASSIS
122
124
BREAKERS
12B
BRANCH CKT
MORE POOL LIGHTS
POOL LIGHTS

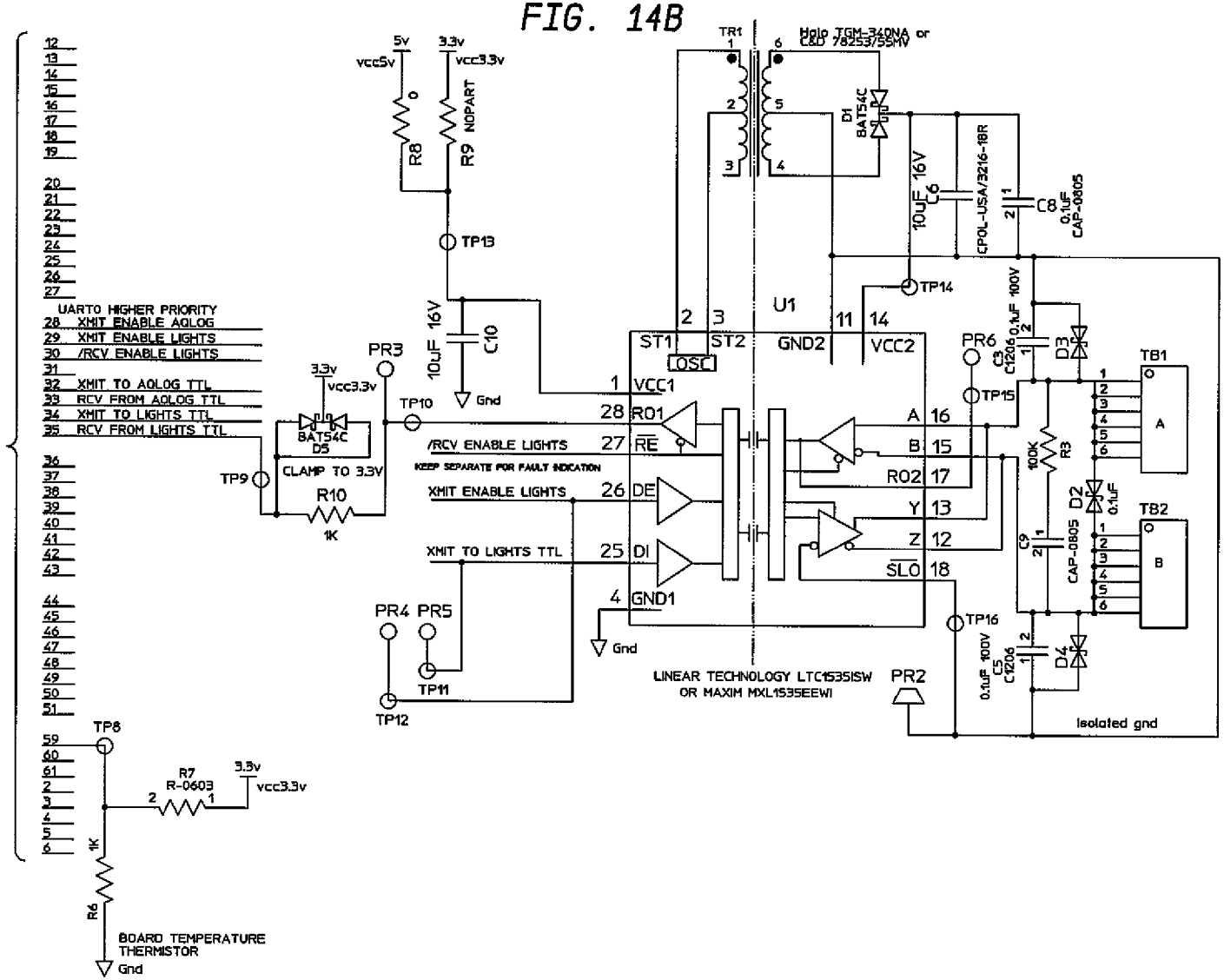
FIG. 14B
CONTINUED FROM FIG. 14A

PROGRAMMABLE UNDERWATER LIGHTING SYSTEM

RELATED APPLICATIONS

This application claims the benefit of U.S. Provisional Application Ser. No. 60/861,607, filed Nov. 28, 2006, the entire disclosure of which is expressly incorporated by reference.

BACKGROUND OF THE INVENTION

1. Field of the Invention

This invention relates to underwater lighting systems, and more particularly for lighting systems used in swimming pools, spas and the like for both safety and aesthetic purposes.

2. Background of the Invention

In-ground swimming pools and spas are often installed with lights, typically in a horizontal row a short distance below the waterline. The underwater lighting has a pleasing visual effect and permits safe swimming during nighttime.

More recently, colored lights have been used, with programmable controllers for turning selected lights on and off, effectively producing an underwater light show for the pool's users. In a typical application, an underwater light fixture (also called a luminaire) includes an array of light-emitting diodes (LEDs) coupled to a microprocessor. A specific color is obtained by powering different LEDs in combinations of primary colors (e.g. LEDs in red, green and blue). A light fixture is turned on or off in accordance with a programmed sequence by alternately supplying and interrupting power to the light fixture. For example, as shown in FIG. 1, a light fixture 110 has an array of LEDs 100 controlled by a microprocessor 115. Each light fixture has a power relay 116 for interrupting power from a power supply 118.

It is desirable to provide a programmable lighting system where the lights may turn on or off, change color and brightness, and/or appear to move, according to programmed sequences (including user-defined sequences) that do not depend on power interruption.

SUMMARY OF THE INVENTION

In accordance with the present invention, a system is provided for programming and displaying lights, especially colored lights, in a swimming pool or spa installation and in associated landscape settings. In particular, a programmable lighting system is provided, including both hardware and software, which permits a user to adjust and control LED light displays; to adjust the speed at which color changes occur in a given light fixture; to use a pre-programmed light show with apparent movement of lights, or to program a new show, and to alter the speed thereof. Furthermore, the system permits the user to exploit these features with wet, dry or sporadic wet/dry fixtures or any combination thereof. Control systems for lighting fixtures may employ an RS-485 communication interface or Power Line Carrier (PLC) technology. In addition, control systems are described for driving LED lighting fixtures at either 12V or 110/120V.

In accordance with another aspect of the invention, the system includes thermal management hardware and software for maintaining lighting component temperatures within rated safe operating temperatures, even when the temperature of a lighting fixture is non-uniform (for example, when a pool lighting fixture is partially submerged).

BRIEF DESCRIPTION OF THE DRAWINGS

Important features of the present invention will be apparent from the following Detailed Description of the Invention, taken in connection with the accompanying drawings, in which:

FIGS. 8A-8E are schematic circuit diagrams of components of a 12V pool lighting system according to an embodiment of the invention, which includes serial RS-485 communications between the controller unit and lighting fixtures;

FIGS. 10A-10F are schematic circuit diagrams of components of the system of FIG. 9;

FIGS. 14A-14B are schematic circuit diagrams of a communications module using an RS-485 communications interface;

DETAILED DESCRIPTION OF THE INVENTION

Embodiments of the invention will be described with particular reference to lighting system components, programmable lighting displays, powering the lighting fixtures, and control systems for the lighting fixtures.

Lighting System Components

Figure 2:
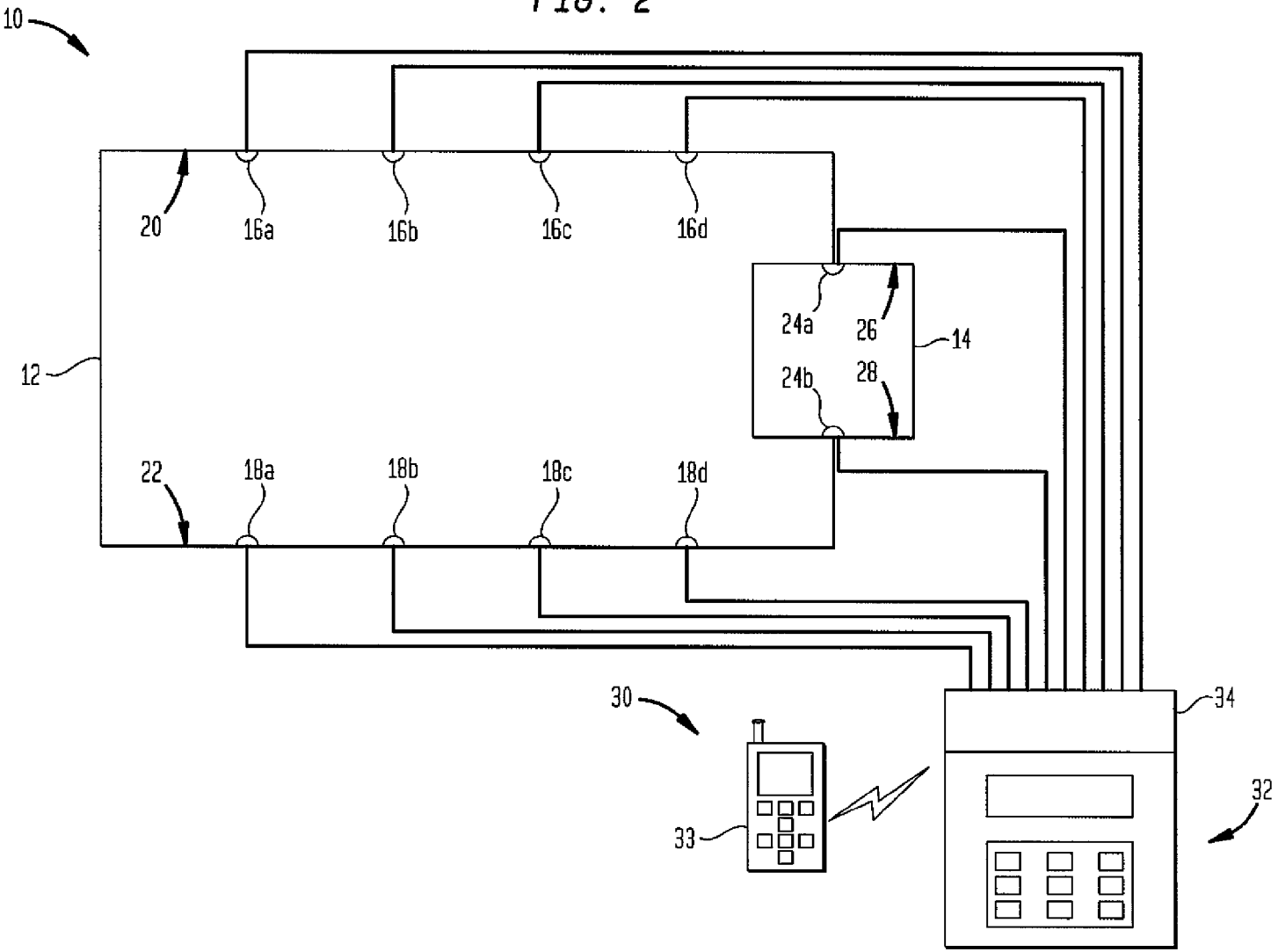
FIG. 2 schematically illustrates a lighting system constructed in accordance with an embodiment of the invention.

FIG. 2 schematically illustrates a lighting system 10 constructed in accordance with the present invention for use in connection with a swimming pool 12 and/or a spa 14. More particularly, the lighting system 10 includes a plurality of light fixtures 16*a*-16*d*, 18*a*-18*d* mounted to side walls 20, 22, respectively, of the pool 12, as well as one or more light fixtures 24*a*, 24*b* mounted to side walls 26, 28, respectively, of the spa 14. The lighting system 10 is also equipped with a control system 30 which is connected to each of the light fixtures 16*a*-16*d*, 18*a*-18*d*, 24*a*, 24*b* for controlling the operation of the light fixtures 16*a*-16*d*, 18*a*-18*d*, 24*a*, 24*b*. More particularly, the lighting system 10 is configured to communicate with the light fixtures 16*a*-16*d*, 18*a*-18*d*, 24*a*, 24*b* so as to cause a selected set or sets of the light fixtures to operate in one of a plurality of predetermined fashions, as will be discussed in greater detail hereinbelow.

Figure 3A:
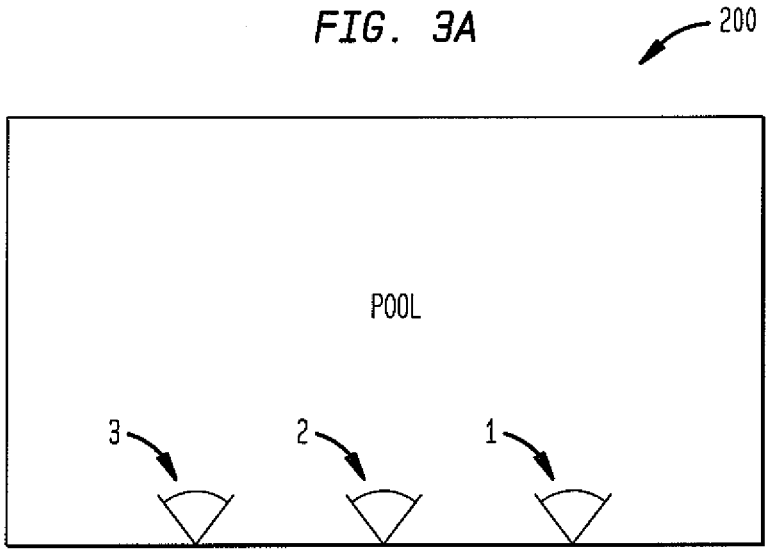
FIGS. 3A-3E are schematic illustrations of programmable systems of swimming pool, spa and landscape light fixtures, in accordance with additional embodiments of the invention.
Figure 3B:
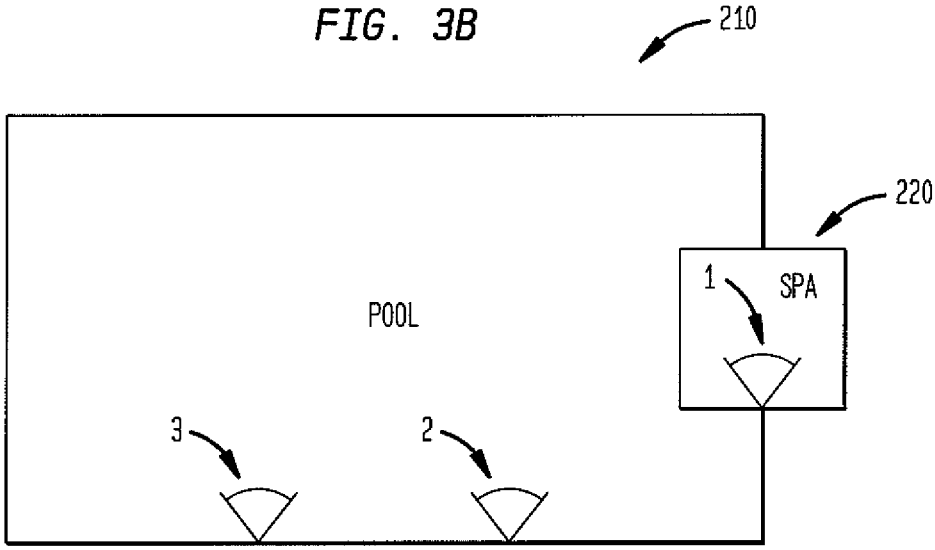
Figure 3C:
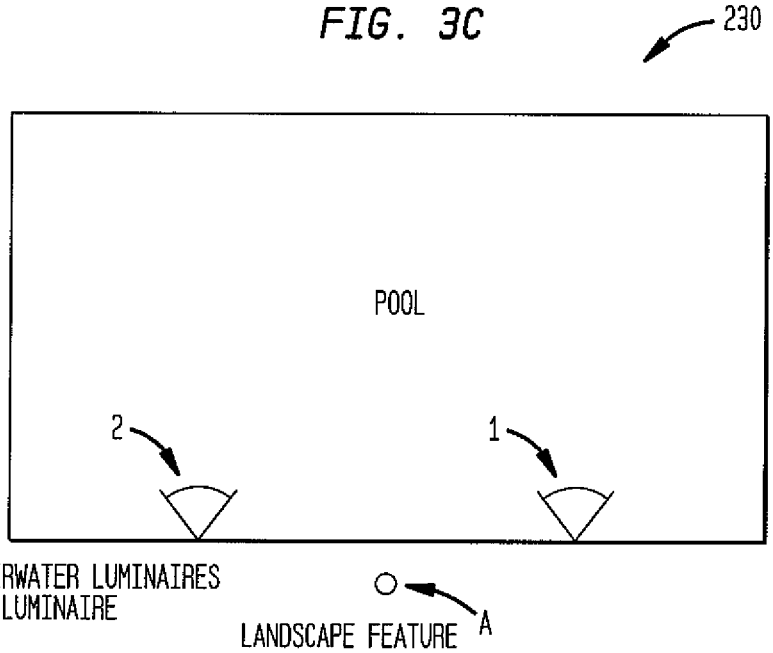
Figure 3D:
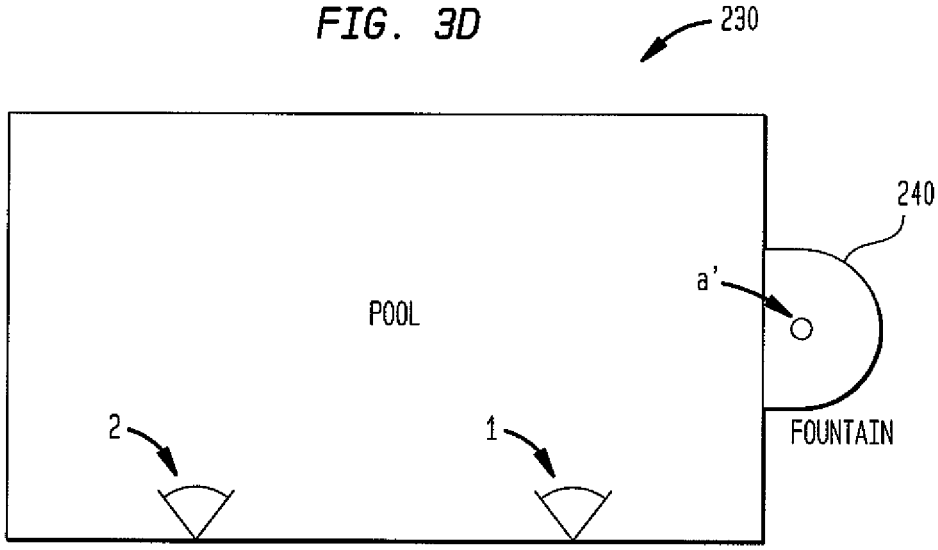
Figure 3E:
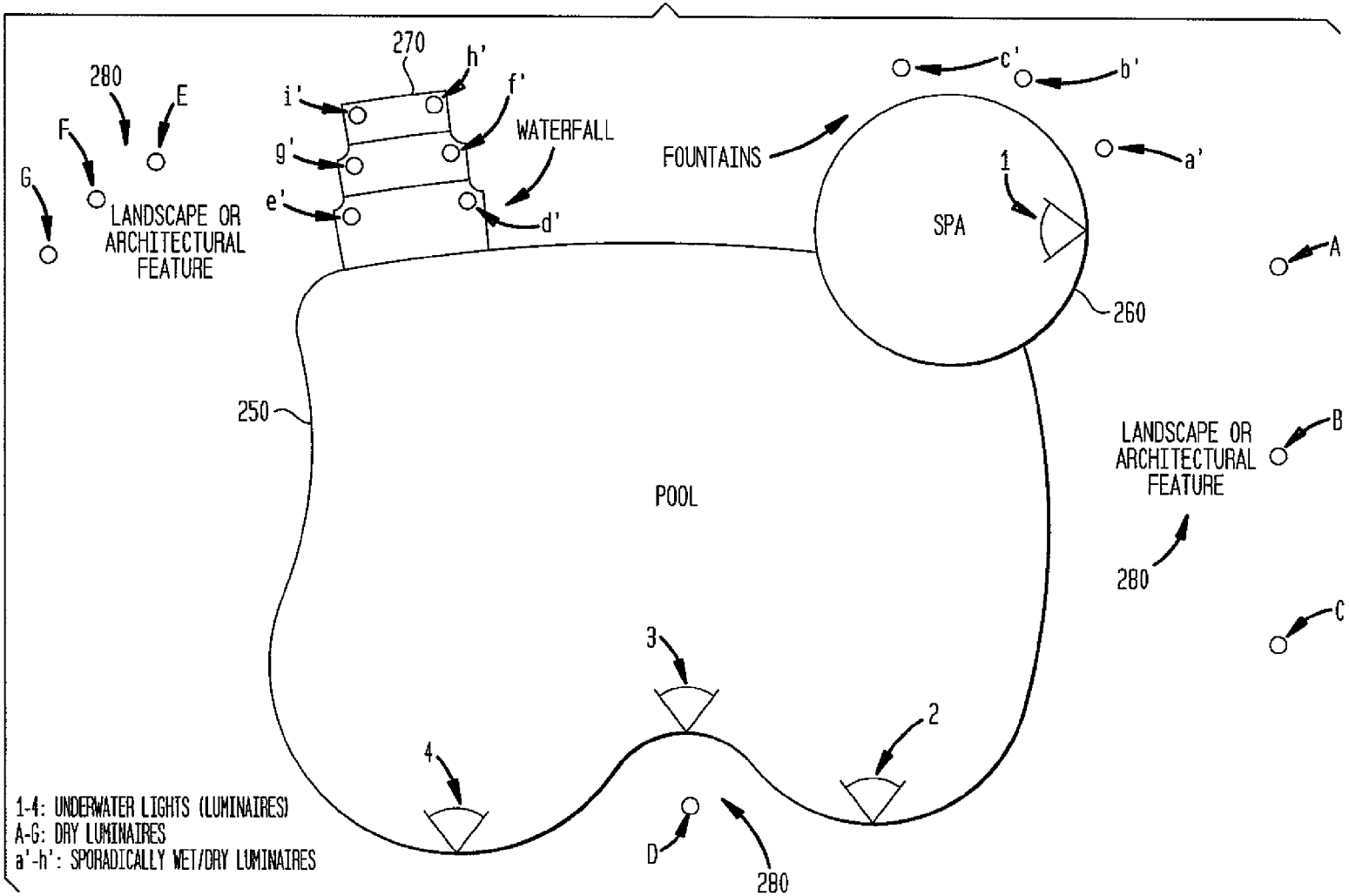

System components may be installed in various arrangements, as shown in FIGS. 3A-3E. FIG. 3A illustrates a basic application in which a set of three fixtures (luminaires) 1-3 is installed below the waterline of a swimming pool 200. The three fixtures are individually addressable and may be programmed for a variety of light displays as detailed below. FIG. 3B shows a variation in which fixture 1 is installed underwater in a spa 220 connected to pool 210. It is not necessary for all of the luminaires to be of the same type; for example, as shown in FIG. 3C, a set of three luminaires may include two underwater fixtures 1, 2 in pool 230 and a fixture outside the pool as a landscape feature (called a dry luminaire) A. Another type of luminaire is sporadically both wet and dry, for example a luminaire a' installed in a fountain 240 as shown in FIG. 3D. A lighting installation using a combination of wet, dry and wet/dry luminaires is shown schematically in FIG. 3E. Swimming pool 250 has underwater luminaires 2-4, and also has a spa 260 and a water feature (e.g. waterfall 270) connected thereto. This installation includes dry luminaires A-G and wet/dry luminaires a'-i', arranged as desired with respect to the pool/spa landscaping and the water features.

It should be noted that the various luminaires (wet, dry and wet/dry luminaires) may be programmed as a single set, or may be divided into subsets programmed separately so that, for example, a different light display may be run simultaneously on the fountain luminaires a', b', c' and on the waterfall luminaires d'-i'. The software for programming the light displays, in accordance with embodiments of the invention, is discussed in more detail below.

Programmable Lighting Displays

With reference to FIG. 2, each of the light fixtures 16*a*-16*d*, 18*a*-18*d*, 24*a*, 24*b* has a construction and/or operation which are similar to those of light fixtures sold previously by the assignee of the present application, Hayward Industries, Inc., d/b/a Goldline Controls, Inc., under the trademark COLORLOGIC® (hereinafter "the prior COLORLOGIC® light fixtures"). For instance, each of the light fixtures 16*a*-16*d*, 18*a*-18*d*, 24*a*, 24*b* includes a plurality of light emitting diodes (LEDs) as a light generator and is adapted to be submersed underwater for providing underwater illumination. Each of the light fixtures 16*a*-16*d*, 18*a*-18*d*, 24*a*, 24*b* also includes a microprocessor and one or more solid state memories for storing preset light programs. Each of the programs is a list of colors (i.e., a set of steps) to be played back in order and a time between the steps. For example, a program might be specified as a series of one-second steps and the colors red, green, blue and white. The programs can include one or more of "animated" (i.e., color-changing) light programs, such as the light programs utilized in the prior COLORLOGIC® light fixtures under the names "VOODOO LOUNGE", "TWILIGHT", "TRANQUILITY", "GEMSTONE", "USA", "MARDI GRAS" and "COOL CABARET". When one of the color-changing programs is executed, each corresponding light fixture generates a lightshow by sequentially producing lights having predetermined colors. For example, when the "USA" program is triggered, the light fixture sequentially generates a light having the red color, a light having the white (clear) color, and a light having the blue color. In addition, the programs can include one or more fixed light programs, such as those utilized in the prior COLORLOGIC® light fixtures under the names "DEEP BLUE SEA", "AFTERNOON SKY", "EMERALD", "SANGRIA" and "CLOUD WHITE". When one of the fixed light programs is selected, the light fixtures produces a constant light having a fixed color (e.g., when the "DEEP BLUE SEA" program is selected, the light fixture transmits a constant light having a blue color).

The control system 30 includes a controller 32 which is similar, in construction and operation, to pool/spa controllers sold by Hayward Industries, d/b/a Goldline Controls, Inc., under the trademark AQUA LOGIC® (hereinafter "the prior AQUA LOGIC® controllers"). For instance, the controller 32 includes a microprocessor and one or more memories. The controller 32 is connected to each of the light fixtures 16*a*-16*d*, 18*a*-18*d*, 24*a*, 24*b* for sending and receiving instructions and/or data to and from the light fixtures 16*a*-16*d*, 18*a*-18*d*, 24*a*, 24*b*. Each of the light fixtures 16*a*-16*d*, 18*a*-18*d*, 24*a*, 24*b* is addressable by the controller 32 such that the light fixtures 16*a*-16*d*, 18*a*-18*d*, 24*a*, 24*b* can be controlled selectively and independently by the controller 32. In this manner, one or more light fixtures 16*a*-16*d*, 18*a*-18*d*, 24*a*, 24*b* can be operated simultaneously by the controller to create a "moving" lightshow, as will be discussed further below. The controller also includes a display (e.g., a liquid crystal display) and a plurality of input keys for user interface. A wireless display keypad 33 may also be provided for remote, wireless user interface.

The controller 32 can also be configured to control the operation of other pool/spa equipment. Such equipment can include pool and spa heaters, pumps, etc. (not shown in the figures). The controller 32 can be configured to control such equipment in the same basic manner as the prior AQUA LOGIC® controllers.

The control system 30 also includes a communication device or board 34 for allowing the controller 32 to communicate with the light fixtures 16*a*-16*d*, 18*a*-18*d*, 24*a*, 24*b*. The communication device 34 can be housed in a casing together with the controller 32 and can be constructed in any conventional manner which allows networking of the light fixtures 16*a*-16*d*, 18*a*-18*d*, 24*a*, 24*b* with the controller 32. In an embodiment of the invention, communication device 34 utilizes networking through electrical power lines (e.g., hot and/or neutral lines connected to the light fixtures 16*a*-16*d*, 18*a*-18*d*, 24*a*, 24*b* for delivering electrical power thereto). More particularly, the communication device 34 receives signals from the controller 32 and transmits same to the light fixtures 16*a*-16*d*, 18*a*-18*d*, 24*a*, 24*b* through the power lines and vice versa. Alternatively, the communication device 34 can utilize communication through separate data lines (e.g., RS-485 or Ethernet cables). Other networking means (e.g., wireless and/or optical communications) can be utilized for allowing communication between the controller 32 and the light fixtures 16*a*-16*d*, 18*a*-18*d*, 24*a*, 24*b*. The control system 30 may utilize the communication specification and commands discussed in attached Appendices A and B, which are incorporated herein and made part hereof.

The controller 32 of the present invention is configured such that the light fixtures 16*a*-16*d*, 18*a*-18*d*, 24*a*, 24*b* can be assigned into one or more sets for the purpose of creating desired lightshows. For instance, the light fixtures 16*a*-16*d*,

18*a*-18*d* can be assigned to a set so as to create a lightshow that "moves" along the side wall 20 of the pool (see FIG. 2), or jumps back and forth from the side wall 20 of the pool to the side wall 22 of the pool, as will be discussed in greater detail below.

The operation of the lightshows can be configured by the user during the initial set-up or configuration of the controller. Once the controller is set up, the user can play with the operation of the programs by changing various parameters of the lightshows associated with the programs. These parameters include the brightness of the set of lights and the speed, direction and motion (program spread) of apparent motion of the lights (discussed further below).

Lightshows can be "step" shows where the colors change abruptly from one program step to the next, or they can be "fade" shows where the colors blend from one step to the next. The following discussion applies equally to step or fade shows.

As discussed above, each of the light fixtures includes one or more light programs, each of which is a list of colors (a set of steps) to play back in order, and a time between the steps. For example, a program might be specified as one-second steps and the colors red, green, blue and white. The user may change the speed of the lightshow associated with a particular program (speed up or slow down) by factors of 2 from a minimum of 1/16 normal speed to a maximum of 16 times normal speed.

Configuration of the Control System

During configuration, the light fixtures are assigned to a set and assigned a specified sequence in the set. Typically, the user draws a diagram of the pool and the spa and decides which light fixtures should operate as a collection or set of light fixtures. Collections can overlap, and the system is configured to make reasonable sense out of the overlapping cases.

In a set of light fixtures, the user can decide what sequence each light will be in a show. If the light fixtures 16*a*-16*d*, 18*a*-18*d* (i.e., eight light fixtures in the pool, four on each side) are assigned to a set, the user can choose that the sequence go down both sides of the pool at once by assigning to the light fixtures 16*a*-16*d*, 18*a*-18*d* the sequence of Table 1 (see below). Alternatively, the user can choose that the sequence go around the pool in a circle by assigning the sequence of Table 2 below, or to jump back and forth from side to side by using the sequence of Table 3 below. The setup can be different for each set of light fixtures. The same eight physical light fixtures can be in multiple sets.

TABLE 1

| Sequence Nos. | Light Fixtures |
|---|---|
| 1 | Light Fixtures 16a, 18a |
| 2 | Light Fixtures 16b, 18b |
| 3 | Light Fixtures 16c, 18c |
| 4 | Light Fixtures 16d, 18d |

TABLE 2

| Sequence Nos. | Light Fixtures |
|---|---|
| 1 | Light Fixture 16a |
| 2 | Light Fixture 16b |
| 3 | Light Fixture 16c |
| 4 | Light Fixture 16d |
| 5 | Light Fixture 18d |
| 6 | Light Fixture 18c |
| 7 | Light Fixture 18b |
| 8 | Light Fixture 18a |

TABLE 3

| Sequence Nos. | Light Fixtures |
|---|---|
| 1 | Light Fixture 16a |
| 2 | Light Fixture 18a |
| 3 | Light Fixture 16b |
| 4 | Light Fixture 18b |
| 5 | Light Fixture 16c |
| 6 | Light Fixture 18c |
| 7 | Light Fixture 16d |
| 8 | Light Fixture 18d |

All the light fixtures in the pool are individually addressable. During the setup phase all light fixtures in a particular set are told which program they will be running, at what speed, and with what "motion parameter". That is, each light fixture can be a member of several sets, and the sets are allowed to overlap. As mentioned previously, the homeowner may speed up or slow down the lightshows in the range of 1/16 to 16 times normal speed.

A more detailed discussion of setup steps appears in Appendix C, which is incorporated herein and made part hereof.

Apparent Movement of Light

The lighting system 10 of the present invention is adapted to cause a lightshow program of some number of steps, running on a set of light fixtures, appear to have movement. For example, the program can be four distinct colors each displayed for one second. There are four light fixtures on the pool along one wall, each running the same program but they are started up one second apart. Under these conditions, an observer would say that the four colors were moving across the light fixtures.

If all four light fixtures start the program at the same time, they will all be showing the same colors at the same time, and there will be no apparent movement of color. However, if each light fixture in sequence starts the program a half second apart, the colors will appear to be spread out across two light fixtures as it moves, and fewer colors will be shown at any given time. In this case, the program specified one second steps, and the delay between starting adjacent light fixtures is one second, so the motion is one light at a time.

The concept of "one program step per light" makes more sense than "one second per light". For example, what happens to the motion in the case where the user tells the program to run faster? If one maintains a one second delay, the results are completely different. It makes more sense to think about movement in multiples of a program step than in terms of time.

Motion Parameter

The motion parameters allows the homeowner to specify how much movement a lightshow should have in a way that is independent of the step time of the program, or of the speedup or slowdown in the show playback that the homeowner might make.

The control system is configured such that a motion parameter of zero (i.e., OFF) means no motion. That is, all the light fixtures in the set run the same program at the same time (e.g., if all of the light fixtures in the pool are assigned to the same set, the whole pool changes color in a pattern set by the program). Accordingly, if the light fixtures 16*a*-16*d* are assigned to a set and are instructed to execute a program with a set of one-second steps corresponding to the colors red, green, blue and white, the lightshow shown in following Table 4 may be observed.

TABLE 4

| Time Interval | Light Fixture 16a (Sequence No. 1) | Light Fixture 16b (Sequence No. 2) | Light Fixture 16c (Sequence No. 3) | Light Fixture 16d (Sequence No. 4) |
|---|---|---|---|---|
| 0 | Red | Red | Red | Red |
| 1 | Green | Green | Green | Green |
| 2 | Blue | Blue | Blue | Blue |
| 3 | White | White | White | White |
| 4 | Red | Red | Red | Red |
| 5 | Green | Green | Green | Green |
| 6 | Blue | Blue | Blue | Blue |
| 7 | White | White | White | White |

The control system can be configured such that a motion parameter of one means that "normal motion" occurs. This means that each light in sequence will be one step ahead of its neighbor. This type of show will have a color moving down the row of light fixtures, one light at a time. For instance, if the light fixtures **16*a*-16*d* are assigned to a set and are instructed to execute a program with a set of one-second steps corresponding to the colors red, green, blue and white, the lightshow illustrated in following Table 5 may be observed. As can be seen in Table 5, the colors red, green, blue and white appear to move down along the light fixture 16*a*-16*d*** (see, e.g., the cross-hatched cells in Table 5).

TABLE 5

| Time Interval (Program Steps) | Light Fixture 16a (Sequence No. 1) | Light Fixture 16b (Sequence No. 2) | Light Fixture 16c (Sequence No. 3) | Light Fixture 16d (Sequence No. 4) |
|---|---|---|---|---|
| 0 | Red | White | Blue | Green |
| 1 | Green | Red | White | Blue |
| 2 | Blue | Green | Red | White |
| 3 | White | Blue | Green | Red |
| 4 | Red | White | Blue | Green |
| 5 | Green | Red | White | Blue |
| 6 | Blue | Green | Red | White |
| 7 | White | Blue | Green | Red |

With the same program illustrated in Table 5, a lightshow which moves along the side walls of the pool can be achieved with the use of the set of light fixtures and sequence shown in Table 1 above. Such a lightshow is illustrated in following Table 6.

TABLE 6

| Time Interval (Program Steps) | Light Fixtures 16a, 18b (Sequence No. 1) | Light Fixtures 16b, 18b (Sequence No. 2) | Light Fixtures 16c, 18c (Sequence No. 3) | Light Fixtures 16d, 18d (Sequence No. 4) |
|---|---|---|---|---|
| 0 | Red | White | Blue | Green |
| 1 | Green | Red | White | Blue |
| 2 | Blue | Green | Red | White |
| 3 | White | Blue | Green | Red |
| 4 | Red | White | Blue | Green |
| 5 | Green | Red | White | Blue |
| 6 | Blue | Green | Red | White |
| 7 | White | Blue | Green | Red |

With the light fixtures **16*a*-16*d* and 18*a*-18*d*** mounted to the side walls of the pool, the user can choose to have the lightshow movement around the pool in a circle by using the sequence of Table 2 above. Alternatively, the lightshow movement can be set to jump back and forth from side to side by using the sequence of Table 3 above.

As discussed above, a motion value of zero (i.e., OFF) means all the light fixtures will do the same thing, while a motion value of one means one full step between light fixtures. Motion values falling between zero and one mean that there is less than one full step between adjacent light fixtures. In this case, the program step will overlap two light fixtures. As a result, instead of one light showing one color, it will be spread across several light fixtures. If thought in terms of bands of color, it comes out the following way: motion parameter zero means the band of color covers all the light fixtures, motion parameter one means the band is one light wide, and in between, the band is several light fixtures wide.

Motion parameters can vary between preset values (e.g., motion values of zero to 1.2). Values less than one mean "overlap", and values greater than one means "underlap". For motion values greater than 1, adjacent light fixtures are more than one step apart.

Motion values can be either negative or positive. Positive motion values mean that the apparent movement will be in the ascending order of the sequence numbers assigned to the light fixtures in the set (see Tables 5 and 6 above). Negative motion values mean that the apparent motion will be in the opposite direction (i.e., in the descending order).

The control system of the present invention can be configured such that the motion parameter can be adjusted on-the-fly while a lightshow is running. Such adjustment may produce dramatically different visual effects. Additionally, it is noted that the motion parameter could be used with lighting programs having variable step sizes. In such circumstances, the lighting program would include a parameter which indicates a standard shifting time, or a default step size, which could be used for motion calculations by the lighting program.

The control system also allows the user to select the brightness of the set of lights (e.g., by scaling brightness parameters associated with one or more color values), and to select fixed colors which can each be recalled. These colors are sometimes called "favorite colors". This is done by allowing the user to change the fixed colors that come with the system. The control system may include one or more programs which permits the user to program one or more custom movement shows. The user can use the "favorite colors" to build a movement show. For instance, the user can pick five custom colors, and put them together into a movement show by using one of these programs. One runs them as a step show, one as a fade show. Color mixing in a light show can be achieved by controlling the brightness of a mix of red, green, and blue values, and overall brightness can be controlled by scaling the color mix (e.g., red, green, and blue values) up or down by desired amounts.

In order to start one of the light programs stored in the control system, the user presses an aux button (or a timer turns on the aux) on the controller, which is programmed to run a particular program with a particular set of light fixtures during configuration. A message is broadcast by the communication system to all light fixtures assigned to the aux button telling them that they should start the program number they have stored. Each light fixture looks at its sequence number (its place in the show). Its sequence number determines where in the show it starts. In other words, the light applies a formula to its sequence number to see at what step in the lightshow program it should start executing. The determination is in two steps. First, it determines what its offset would be if the motion parameter were one (normal offset), then it calculates a change to that number based on the motion parameter. The formula makes use of the modulo operator, "%". The formula is the sum of a base offset and a motion offset which are calculated as follows:

Base offset=(# of program steps−(sequence # % # of program steps)) % # of program steps;

and

Motion offset=(1−motion factor)×sequence #, if result is less than zero, add # of program steps.

The resulting number may be a fractional step number. In this case, the software handles getting the time pointer to an intermediate step. The software runs the light show program very quickly to get to the desired starting location, then goes to normal operation.

All of this is done in response to a command from the controller to start up an aux button, as part of communications processing. Once the startup is handled, the main software loop handles updating the light shows. The main loop sees if incoming communications data needs to be processed and if the light show program needs to move to next step.

In view of the foregoing description, it will be appreciated that a user of a programmable lighting system in accordance with an embodiment of the invention may adjust the rate of change of light emitted from a light fixture; adjust the speed of a pre-programmed, color-changing light show; adjust the brightness of the light emitted by a set of lights; build a light show using selected custom colors; and adjust and control the speed of color transitions between light fixtures, thereby orchestrating the apparent movement of colors among multiple lights. The foregoing adjustability, as well as other user-adjustable features, are discussed in attached Appendix D, which is incorporated herein by reference and made part hereof.

Powering the Lighting Fixtures

Figure 5:
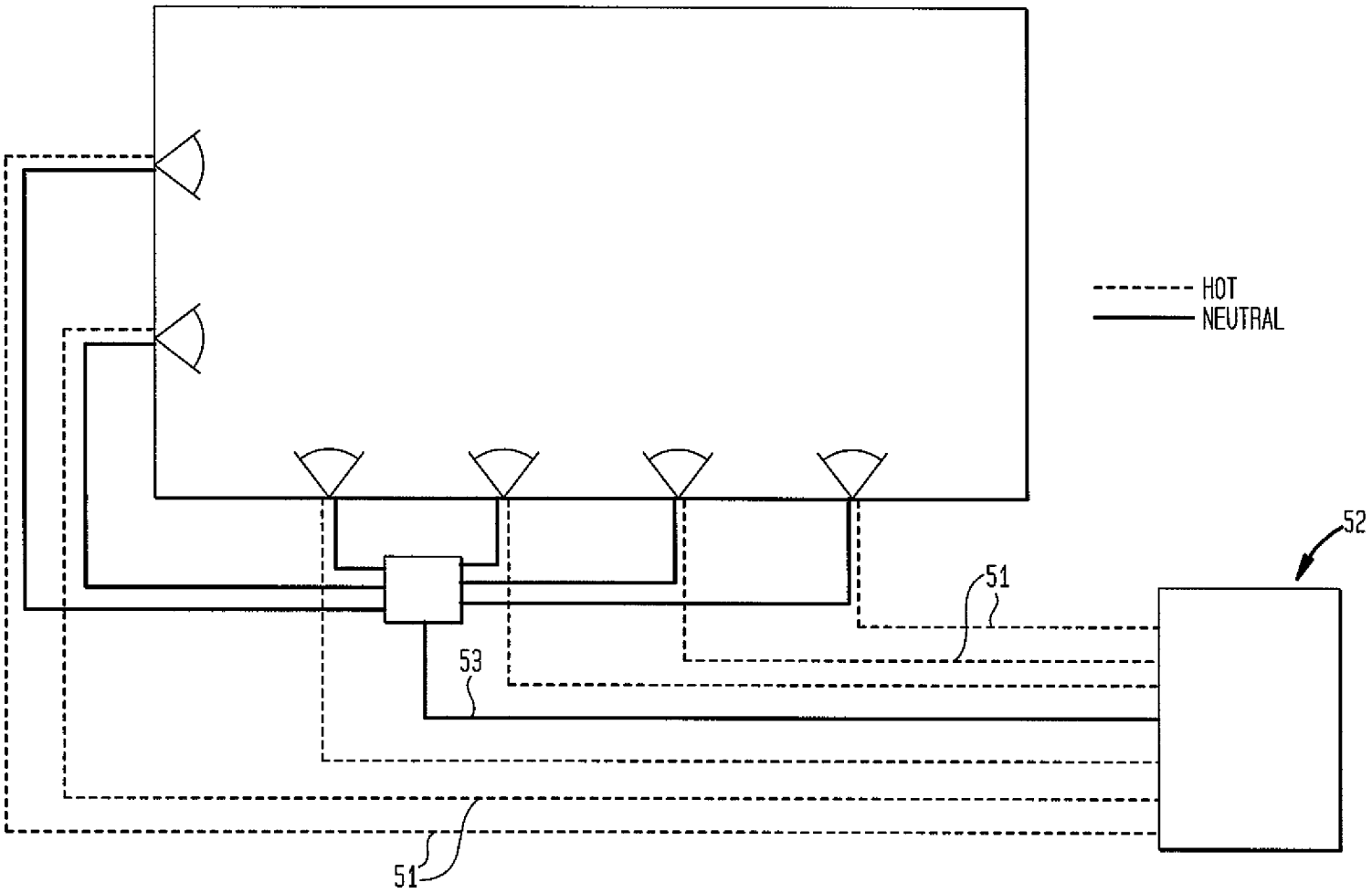
FIG. 5 (PRIOR ART)
FIGS. 5 and 6 illustrate power connections in conventional swimming pool lighting installations.
Figure 6:
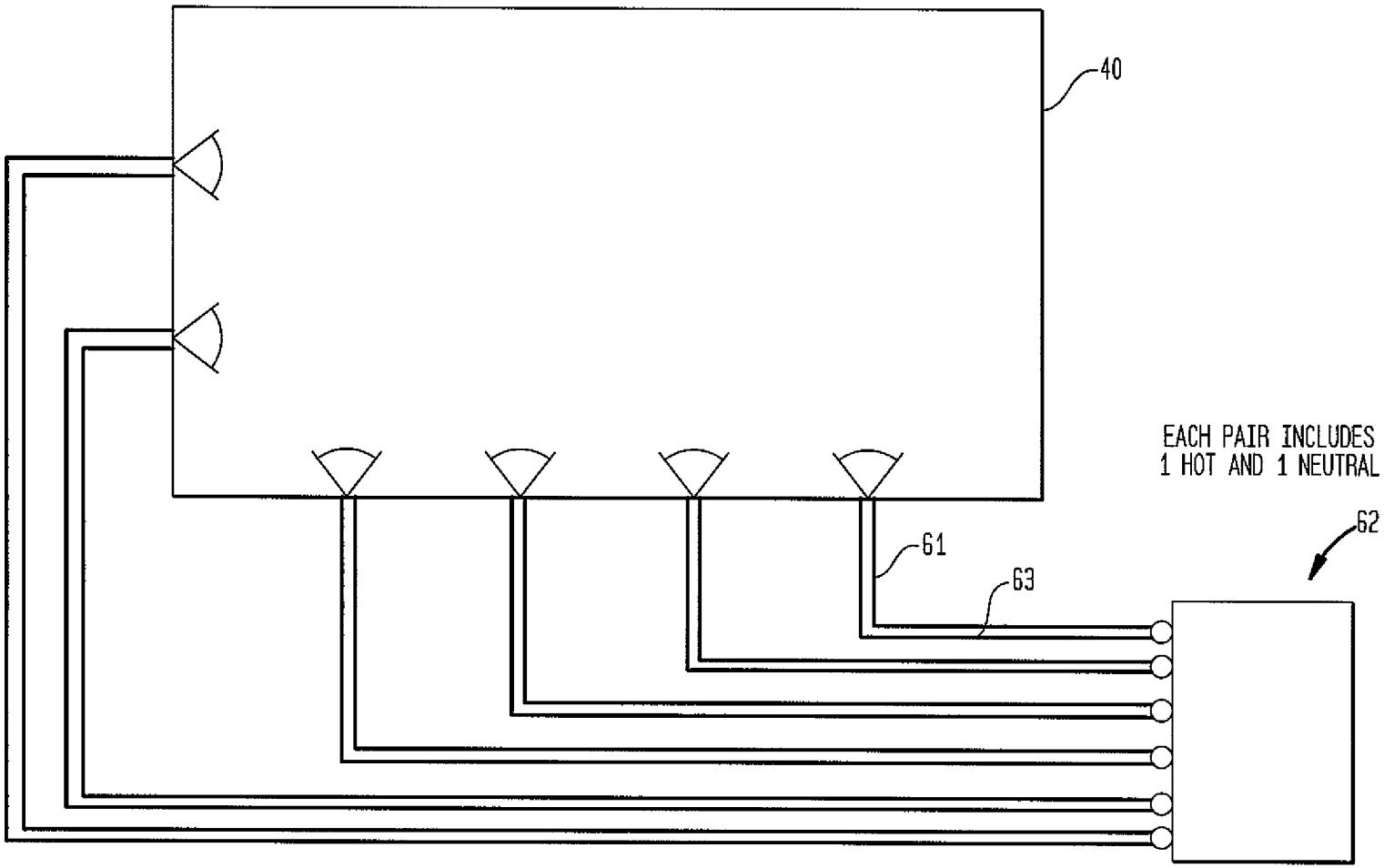
FIG. 6 (PRIOR ART)

As mentioned above with reference to FIG. 2, the various lighting fixtures are powered from controller 32 by hot and/or neutral lines connected to the lighting fixtures. In another embodiment, shown schematically in FIG. 4, lighting fixtures 1-6 along the sidewalls of pool 40 each have a pair of power lines 41*a*, 41*b* (e.g., in an AC system, one hot line and one neutral line; or, in a transformer or DC system, two power lines) connected to a distribution box 43 which in turn is connected by a pair of power lines 45*a*, 45*b* to controller 42. The controller includes a communication board (COM) 44. This arrangement of power lines allows wiring of the lighting fixtures to a centralized location adjacent to the pool. This arrangement is in contrast to the conventional arrangement of FIG. 5, in which multiple hot connections 51 are made between the controller 52 and the fixtures while a single neutral connection 53 is shared among the fixtures. The embodiment shown in FIG. 4 also may be contrasted with the conventional arrangement shown in FIG. 6, in which a separate pair of power lines, each including a unique hot connection 61 and neutral connection 63, is provided from the controller 62 to each light fixture.

Details of Lighting Systems

In embodiments of the invention, a pool/spa/landscape lighting system includes a controller and a communication board and delivers power at either 12V AC or 110/120V AC to a set of lighting fixtures, with the controller and communication board connected using an RS-485 communication interface. In other embodiments of the invention, communication from the controller uses Power Line Carrier (PLC) technology. Details of these embodiments are given below.

Figures 7A, 7B:
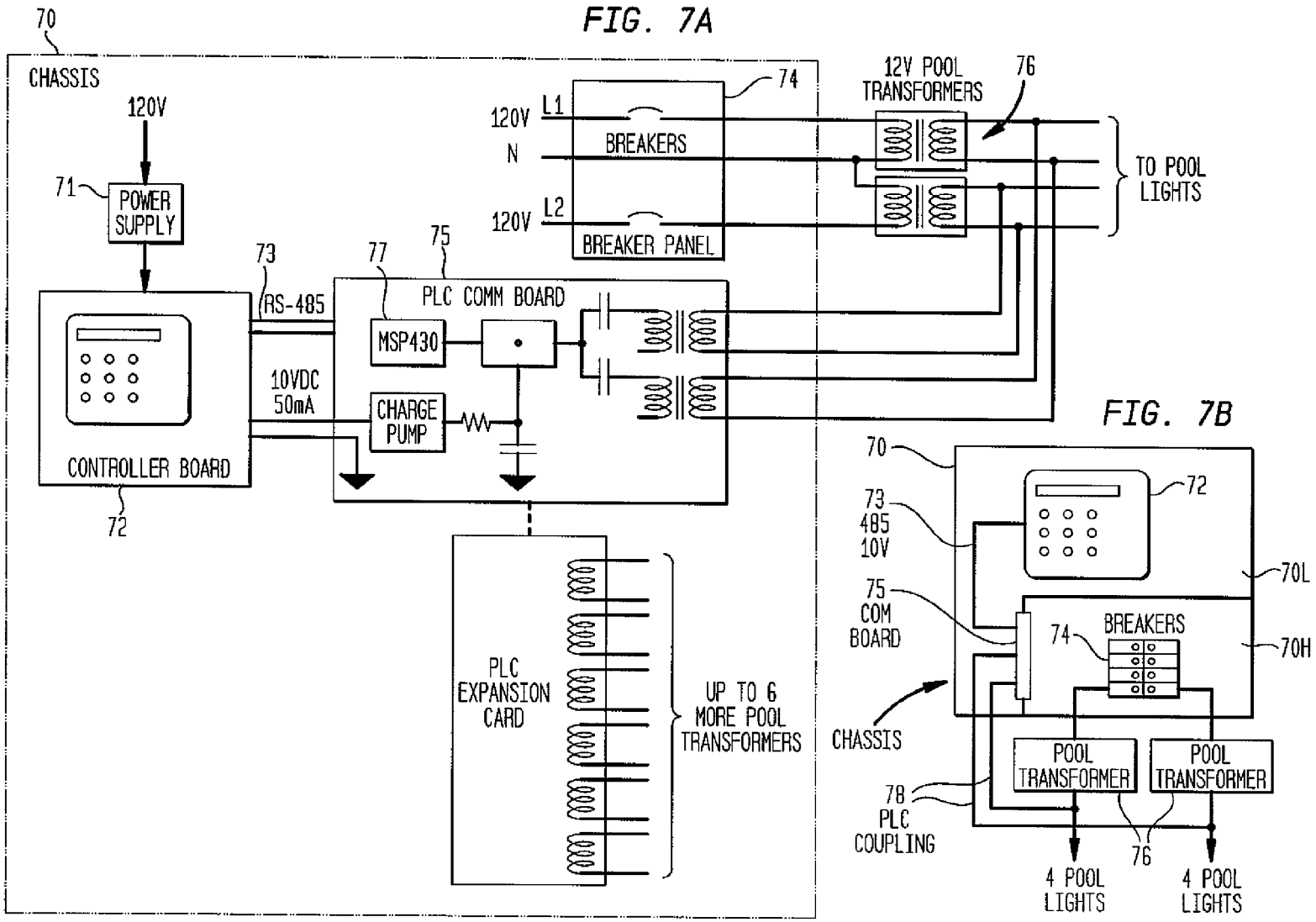
FIGS. 7A and 7B are block diagrams of a controller unit in a 12 volt (V) pool lighting system according to an embodiment of the invention, which includes Power Line Carrier (PLC) communications between the controller unit and lighting fixtures.

FIGS. 7A and 7B are schematic block diagrams of a 12V AC control system 70 for a pool/spa/landscape lighting installation, including a power supply 71, controller 72, and communication board 75, according to an embodiment of the invention. The controller 72 delivers power to the communication board 75 at 10V DC, and directs signals to the communication board using an RS-485 communication interface 73. A set of circuit breakers 74 connect line power at 120V AC to 12 V transformers 76 to deliver low-voltage power to the pool lighting fixtures (not shown). As shown schematically in FIG. 7B, system 70 is divided into a low-voltage region 70L and a high-voltage region 70H. The communication board 75 is coupled to the lighting fixtures using a Power Line Carrier coupling 78, so that both power and signals are carried by the hot and neutral leads to each fixture.

The communications board 75 includes a microprocessor 77. The microprocessor has stored therein networking communication software and the protocol for the PLC communications between the communication board and the lighting fixtures. As discussed below, each lighting fixture also includes a microprocessor and a communications circuit which allows for PLC communications with the controller 72, in addition to thermal management software. The thermal management software controls the intensity of the light according to whether the light is above the waterline or below the waterline.

As shown in FIGS. 7A and 7B, the controller 72 includes a display and keypad accessible by a user, so that software menus may be presented to the user (e.g. a list of available lightshow programs), and so that a user may devise new lightshow programs and input them. It is noteworthy that the control system provides one-stage power conversion for the low-voltage lighting fixtures; that is, transformers 76 convert line current directly to 12V AC power for driving the LEDs in the lighting fixtures.

FIGS. 8A-8E are schematic circuit diagrams of components of a 12V pool lighting system according to an embodiment of the invention, which includes serial RS-485 communications between the controller unit and lighting fixtures. Microprocessor 77, shown in FIG. 8A1, outputs POWER ENABLE signals 83 and PWM signals 84 (see FIG. 8A2) for controlling the LED driver circuits in the various lighting fixtures. The microprocessor links to the controller 72 via the RS-485 interface 73.

Figure 1:
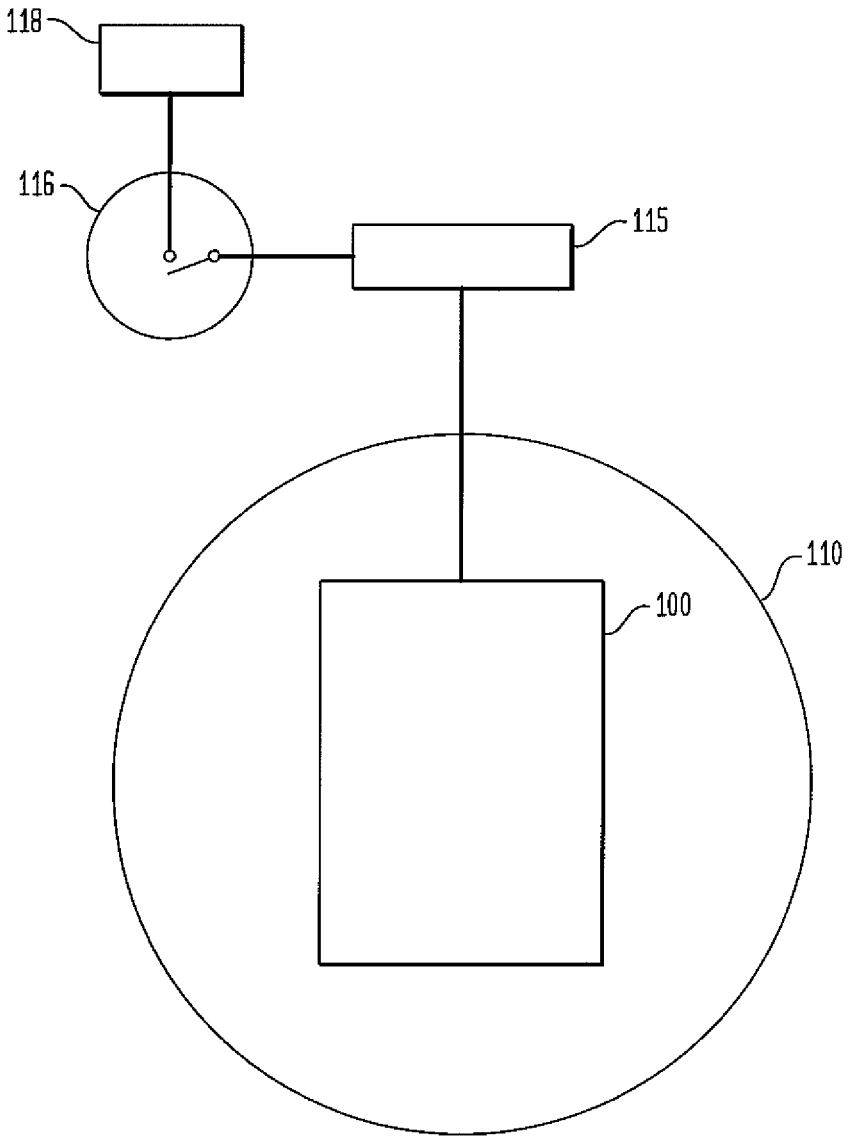
FIG. 1 (PRIOR ART)
FIG. 1 is a schematic illustration of a conventional light fixture including an LED array and a microprocessor.
Figure 4:
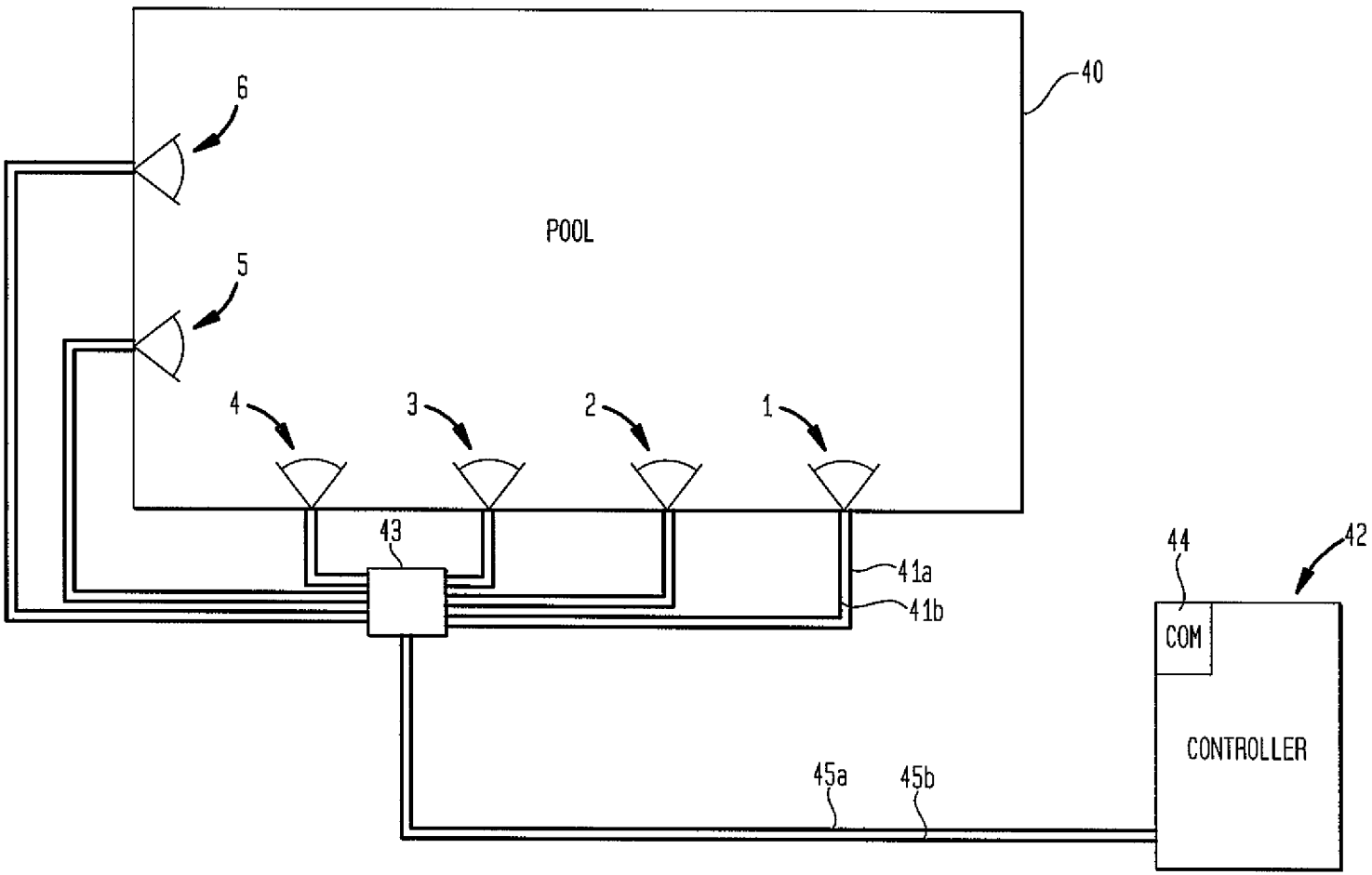
FIG. 4 is a schematic illustration of power connections between a controller unit and a set of swimming pool lights, in accordance with an embodiment of the invention.
Figure 8C:
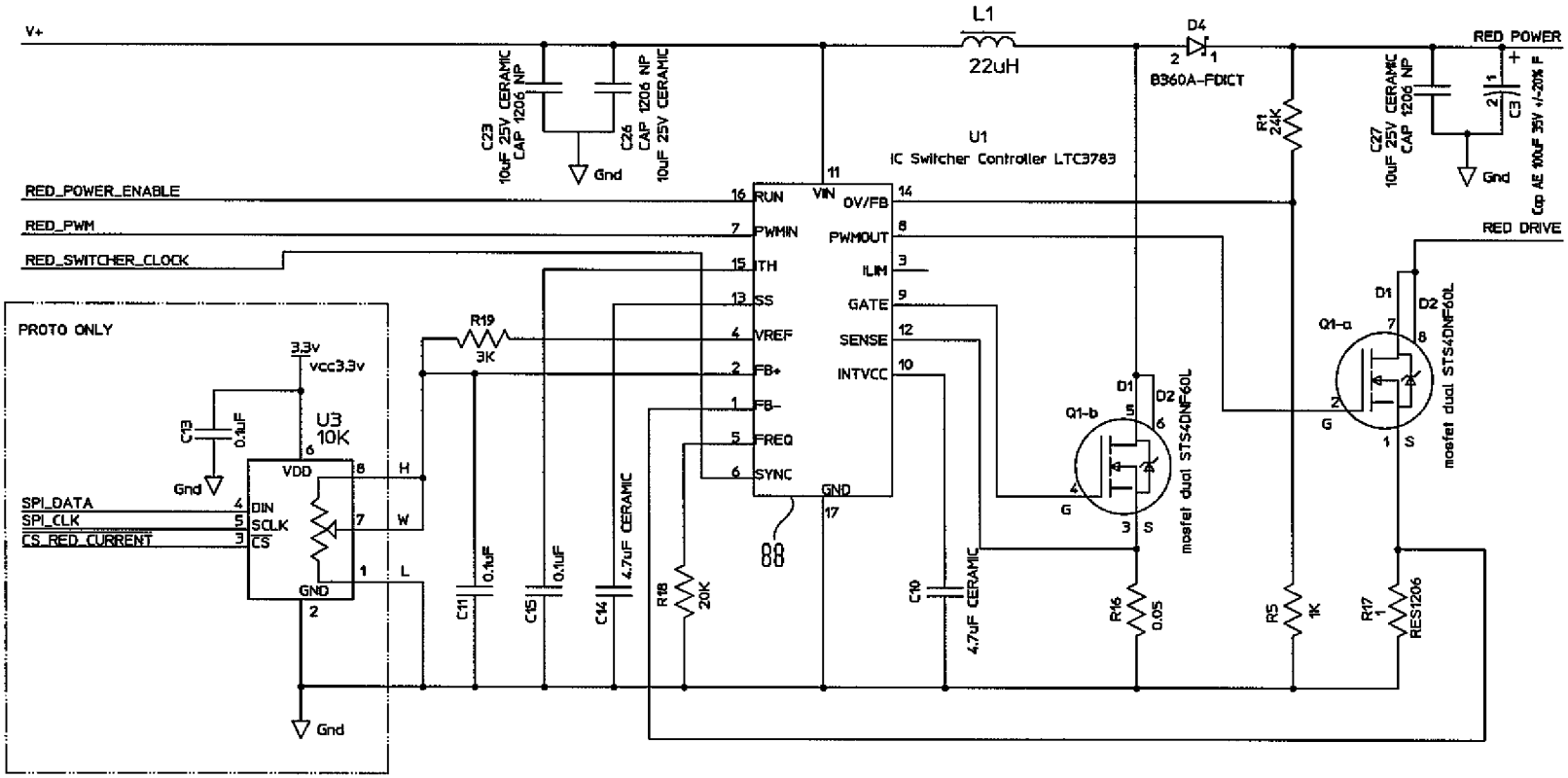
Figure 8D:
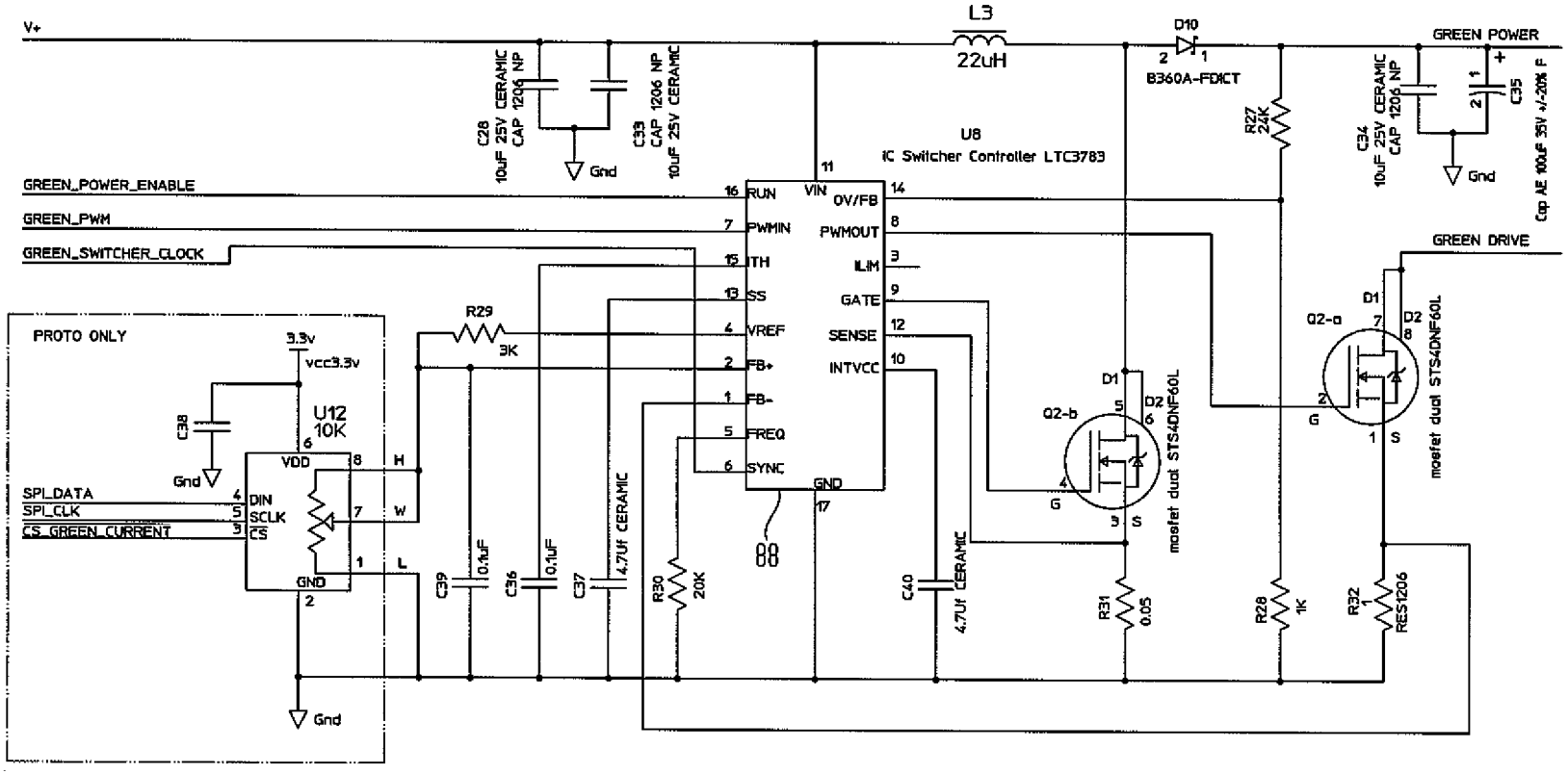
Figure 8E:
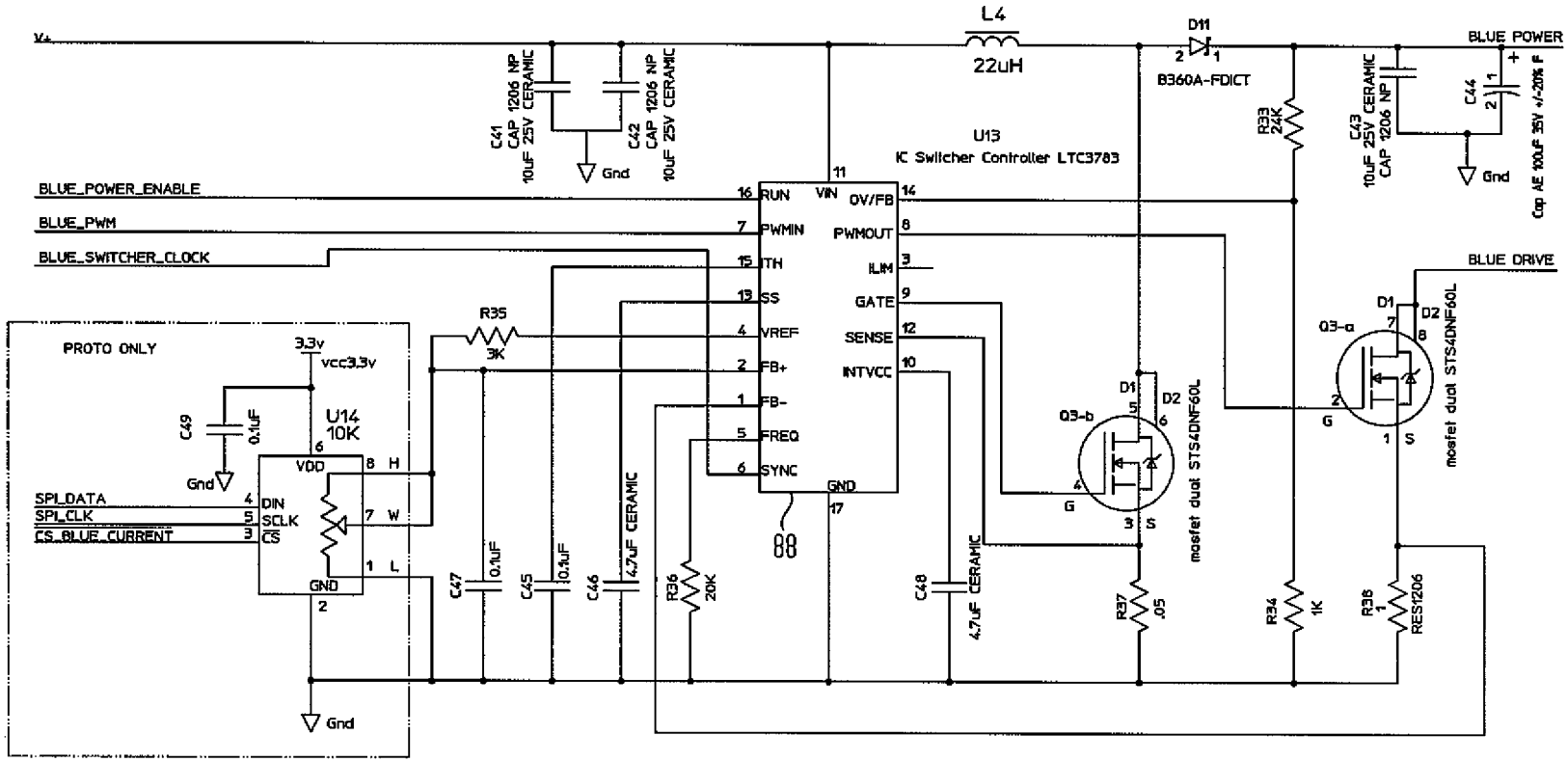

Additional components of the system are shown in FIGS. 8B1-8B4. FIG. 8B1 shows the respective power and drive connections to arrays of red, blue and green LEDs in the lighting fixtures. FIG. 8B2 shows a multiphase clock generator for use in switching the LEDs. FIGS. 8B3-8B4 show a power conversion switching circuit and associated power supply circuitry for use in supplying power to the lighting fixtures, as well as temperature detection and shutdown circuitry (see FIG. 8B4). FIGS. 8C, 8D and 8E show the LED driver circuits for the red, green and blue LEDs of the lighting fixtures respectively. Each driver circuit includes an integrated LED driver device 88 (e.g. linear converter LTC3783 from Linear Technology, Inc.). Device 88 turns on and off in accordance with the POWER ENABLE signal from microprocessor 77.

Figure 9:
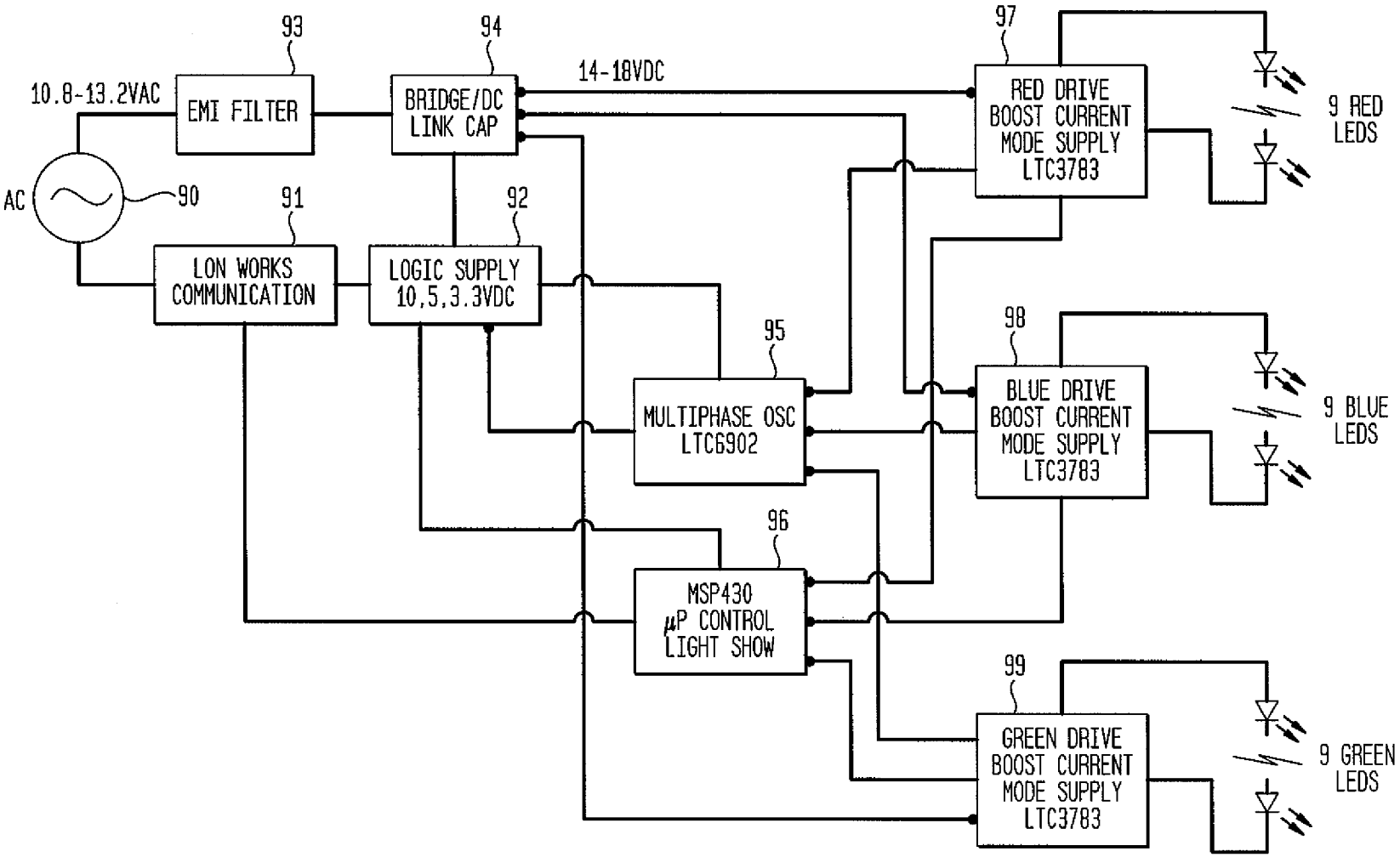
FIG. 9 is a block diagram of a 12V AC pool lighting system using PLC communications between the controller unit and lighting fixtures, in accordance with an embodiment of the invention.

FIG. 9 is a schematic block diagram of a 12V AC lighting system, in accordance with another embodiment of the invention, wherein communications between the controller and lighting fixtures is established using PLC communications. An AC power supply 90 is connected to a PLC communications device 91 and an electromagnetic interference (EMI) filter 93. The PLC communications device 91 and logic power supply 92 are connected to microprocessor 96. DC power is delivered to the LED driver circuits 97, 98, 99 (one each for red, green and blue LEDs) via bridge link capacitor circuit 94, which serves as a rectifier for the AC power supply. The LED driver circuits are also connected to the microprocessor 96 and to multiphase oscillator 95.

Figure 10C:
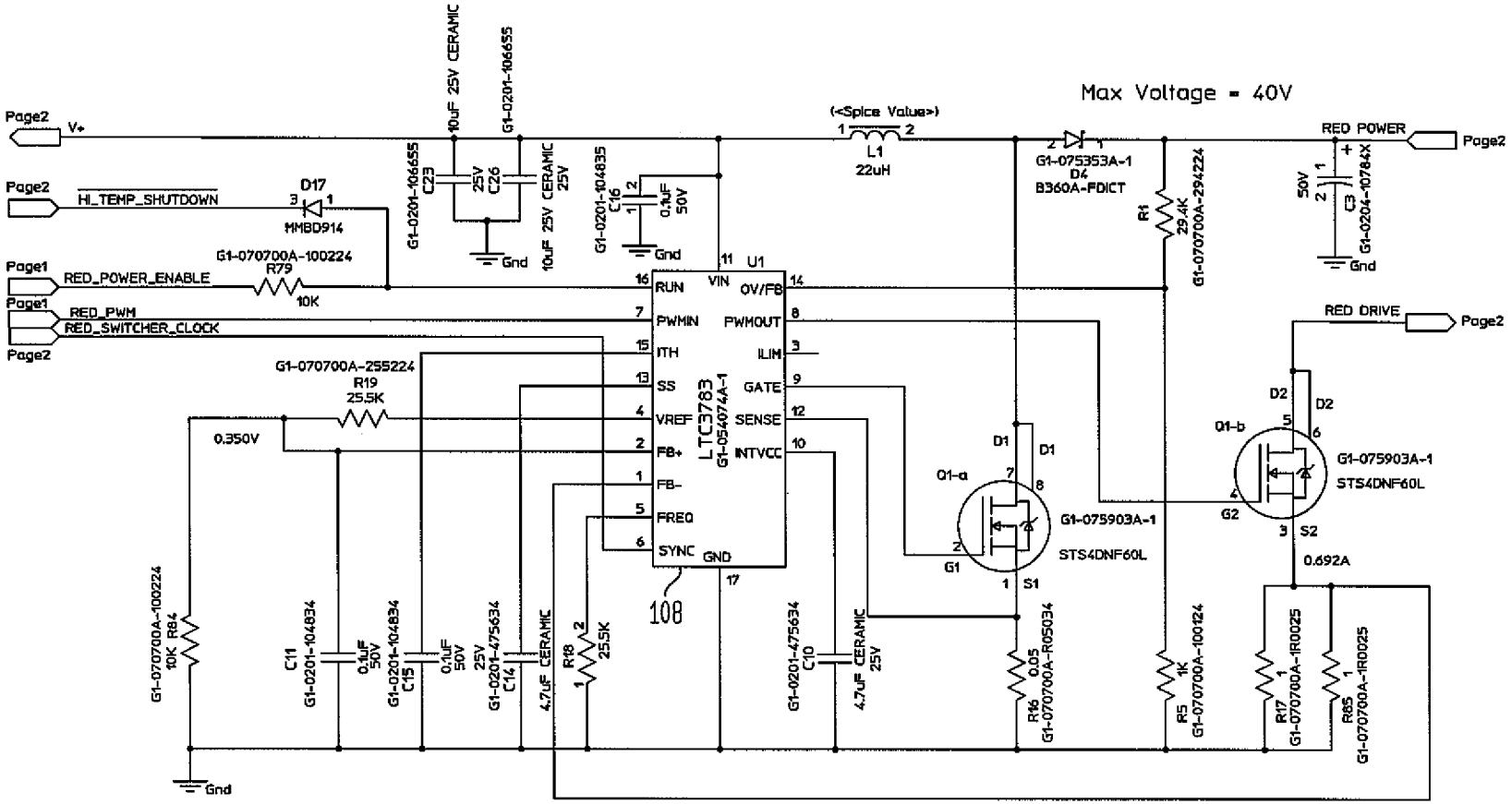

FIGS. 10A1-10A4 are schematic diagrams showing details of the microprocessor 96 in this embodiment. The microprocessor outputs POWER ENABLE and PWM signals 103, 104 to the LED driver circuits, and has a link to an IC transceiver 102 (see FIG. 10A4) which permits network control over power lines. Such a transcevier may be a PL3120 transceiver from Echelon, Inc., or a Lonworks Transceiver Model G1-011034A-1.

Figure 10D:
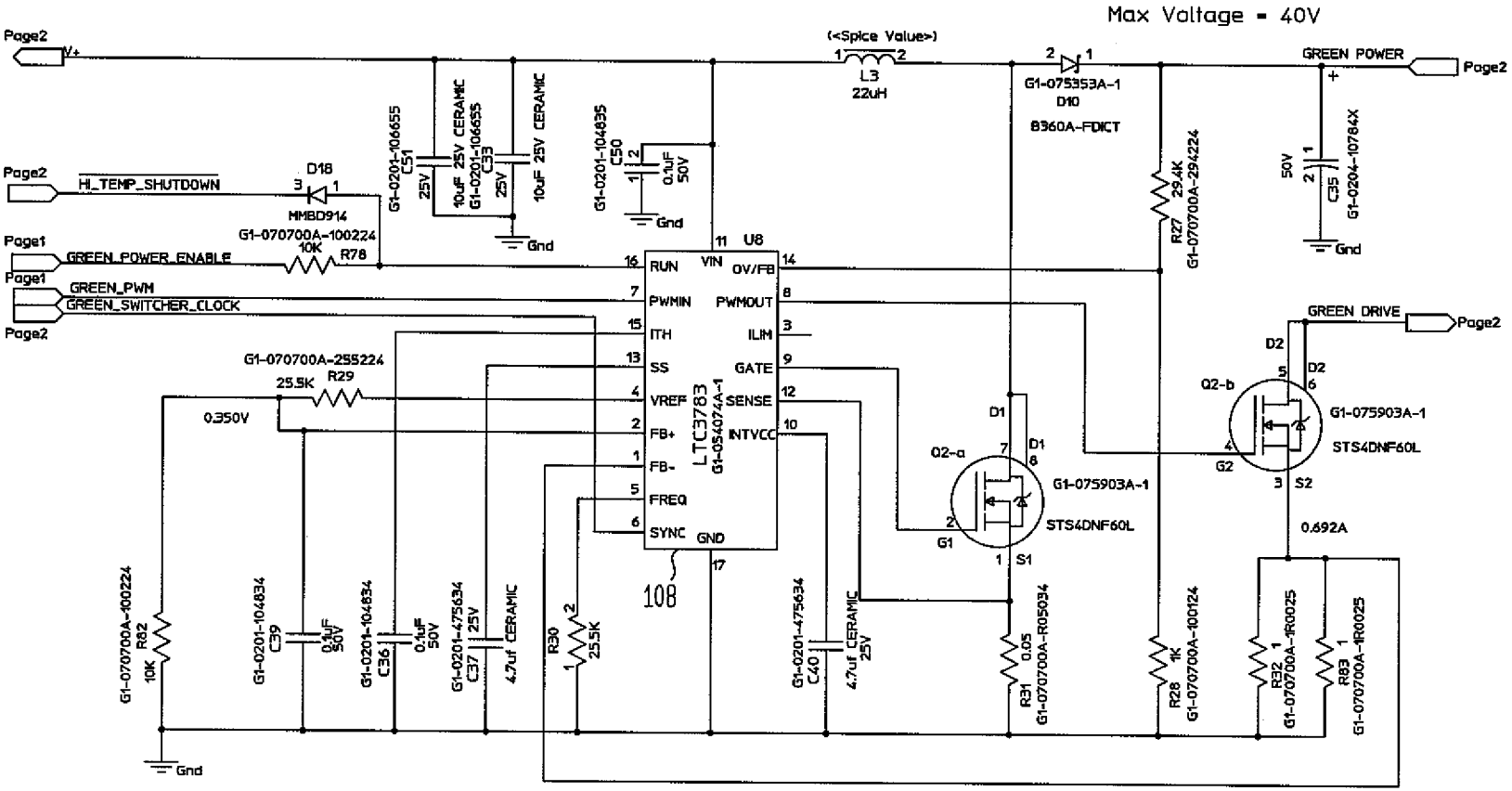
Figure 10E:
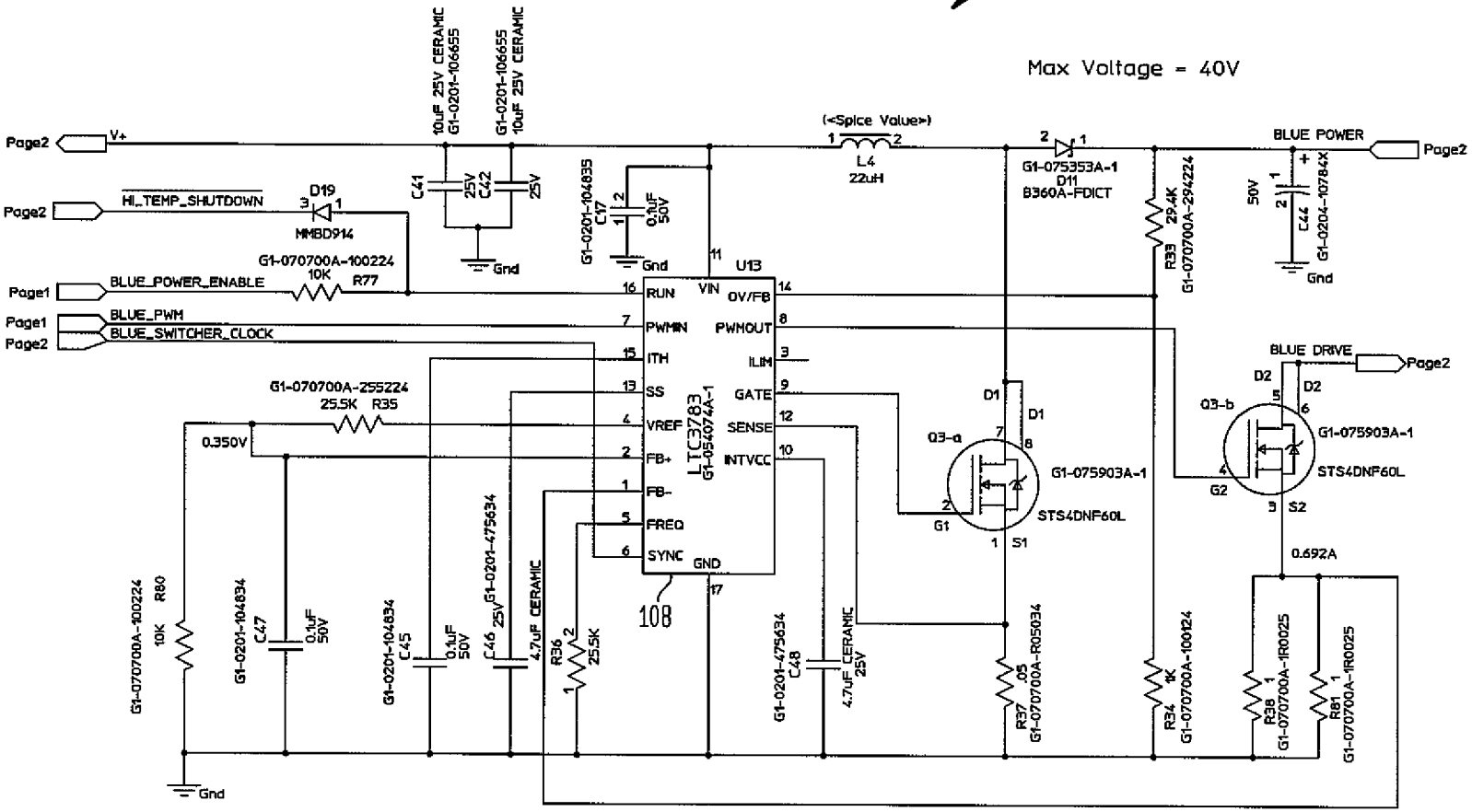
Figure 10F:
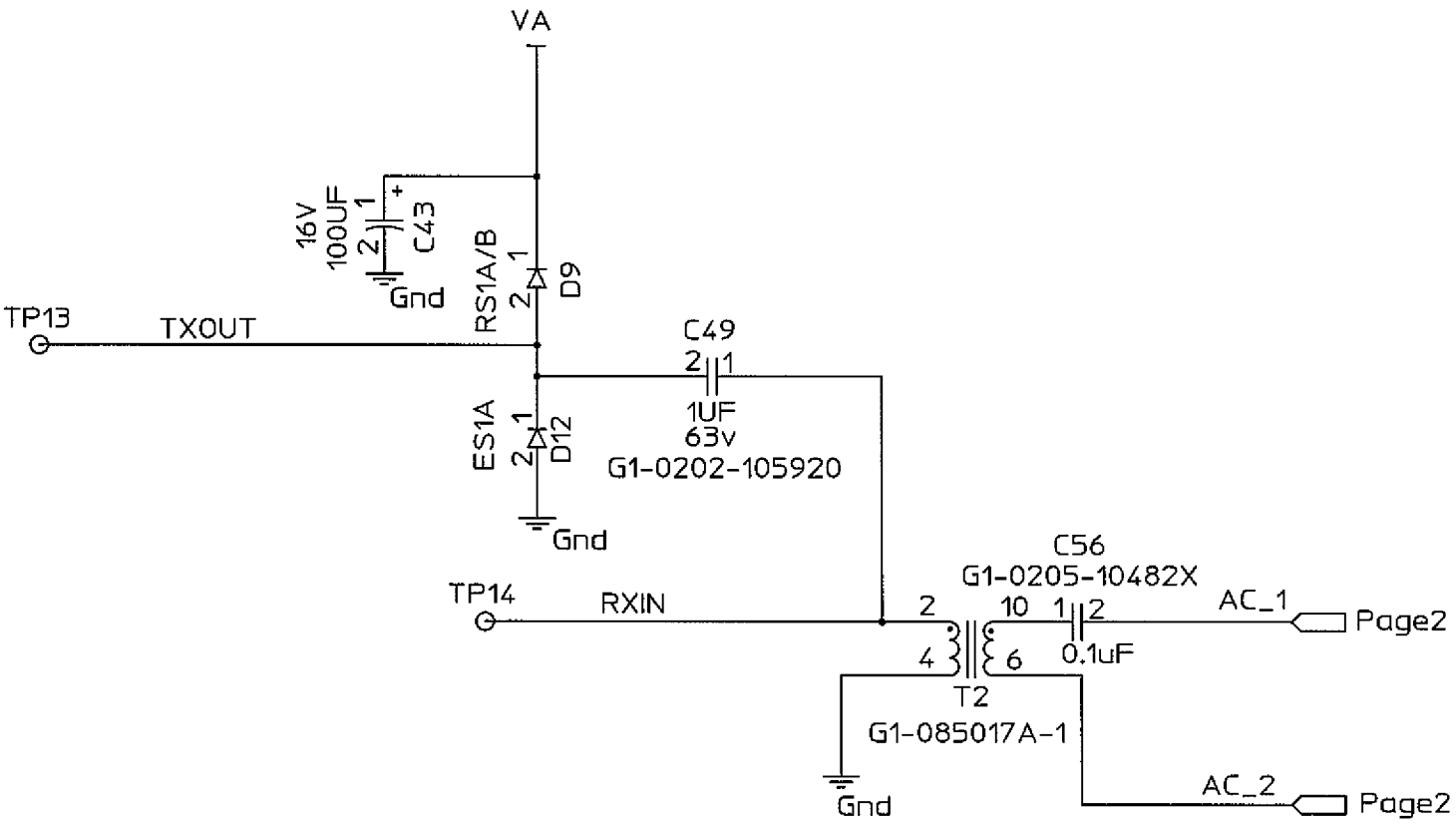

Details of power supply 92 (including circuit 92*a* for producing 10V DC and 5V DC and circuit 92*b* for producing 3.3V DC), as well as circuit 94, multiphase clock generator 95, color LED chains, and associated power supply and test point circuitry, are shown in FIGS. 10B1-10B6 and 10F. The LED driver circuits 97, 98, 99 for red, green and blue LEDs are shown in FIGS. 10C-10E, respectively. Each of these circuits includes a linear boost converter 108 such as LTC3783 from Linear Technology, Inc.

Figure 11:
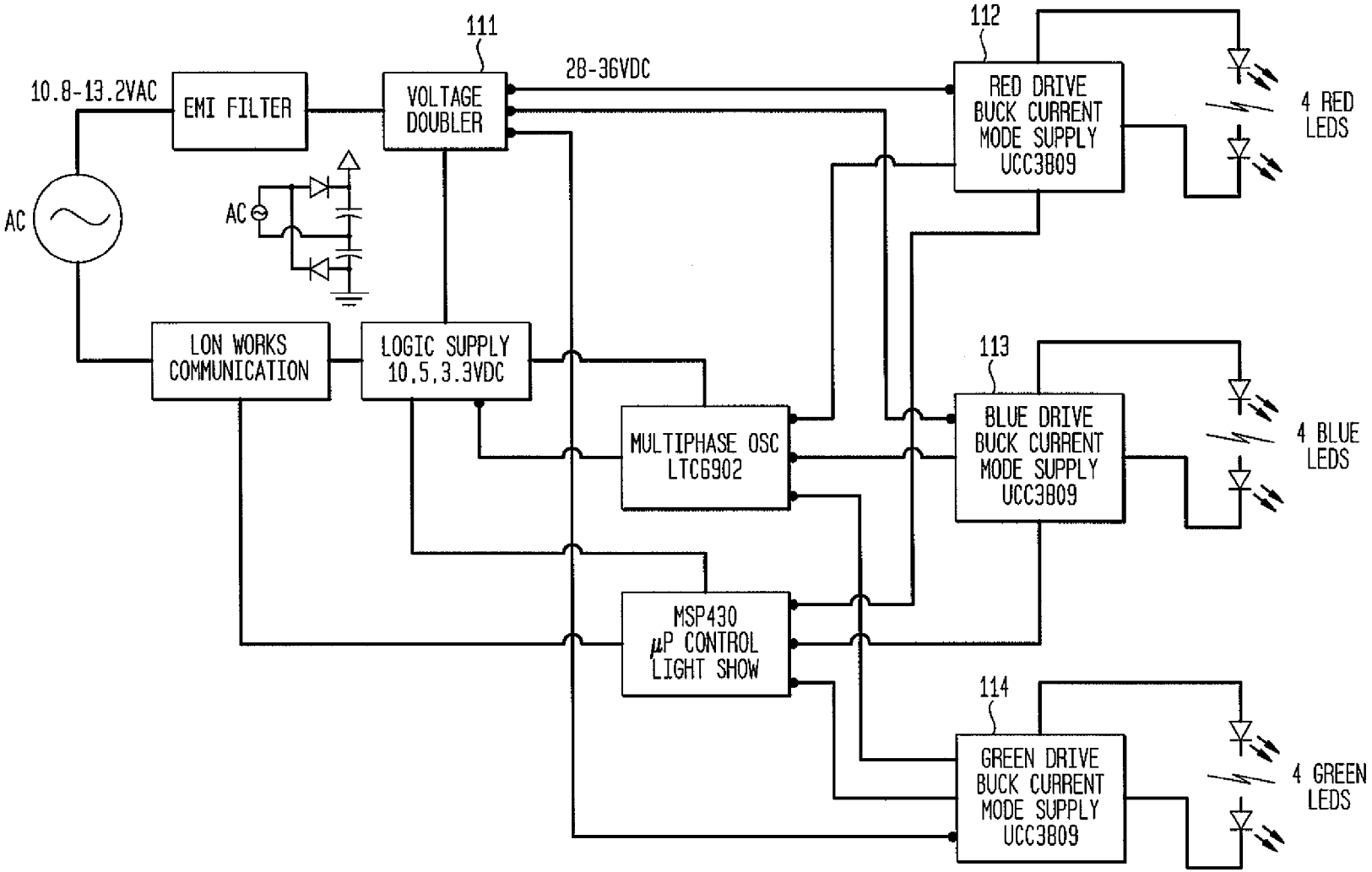
FIG. 11 is a block diagram of a 12V AC spa lighting system using PLC technology, in accordance with an embodiment of the invention.

FIG. 11 is a schematic block diagram for a 12V AC spa lighting system, in accordance with still another embodiment of the invention. The components and connections are similar to the system of FIG. 9, except that a voltage doubler 111 is used in place of circuit 94, so that voltage in the range of 28-36V DC is delivered to the LED driver circuits 112, 113, 114 for driving red, green and blue LEDs respectively. Circuits 112, 113, 114 accordingly include a buck converter (DC-DC step down converter) such as UCC3809 from Texas Instruments, Inc. Each driver circuit is configured to drive four LEDs of the respective color.

Figures 12A, 12B:
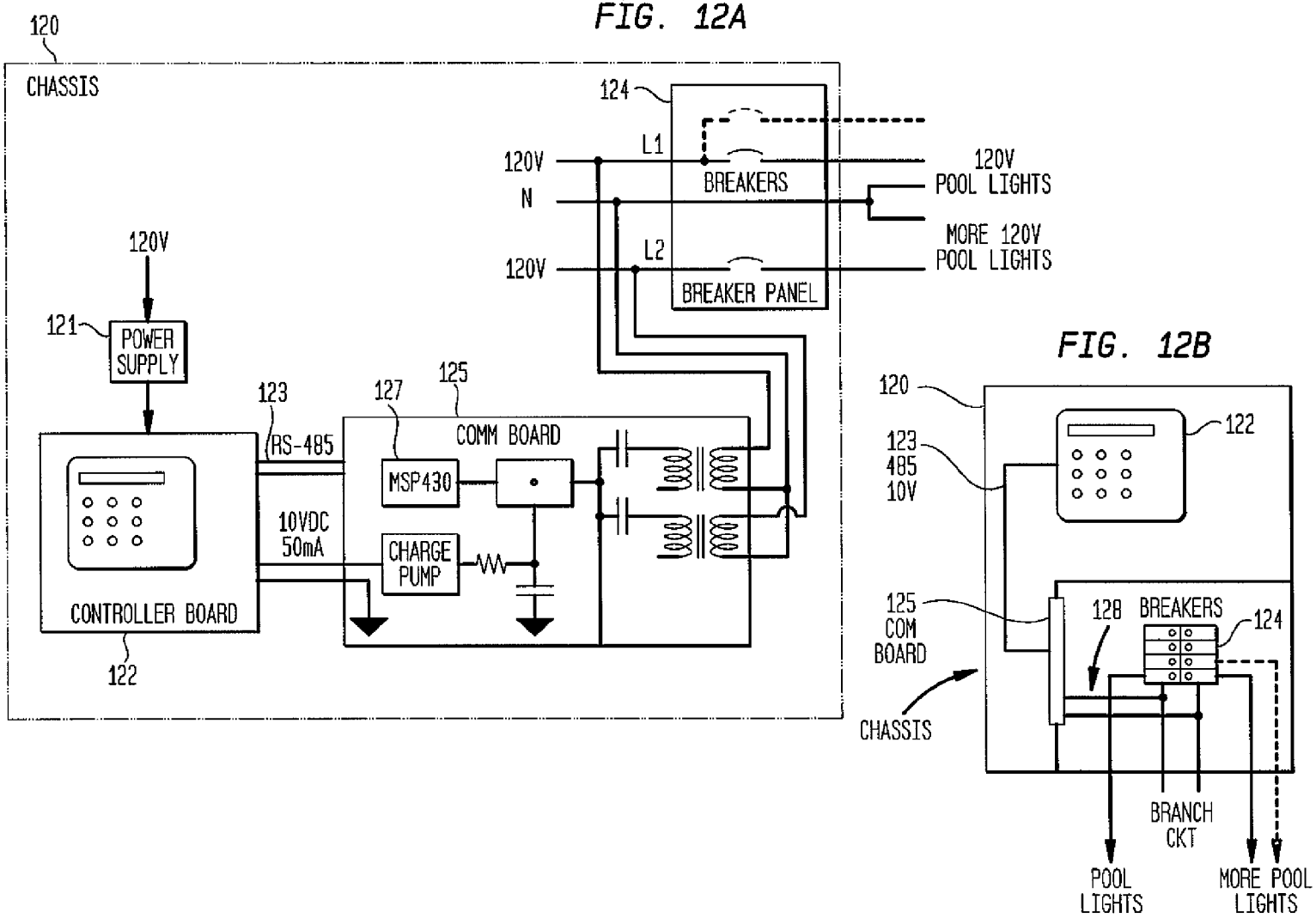
FIGS. 12A and 12B are block diagrams of a controller unit in a 110/120V AC pool lighting system according to an embodiment of the invention, which utilizes PLC technology for communications between the controller unit and lighting fixtures.

FIGS. 12A and 12B are schematic block diagrams of a 120V AC lighting system, in accordance with a further embodiment of the invention. This system is similar in construction to the system of FIGS. 7A and 7B, but does not include 12V transformers. System 120 includes power supply 121, controller 122, and communication board 125. The controller 122 delivers power to the communication board 125 at 10V DC, and directs signals to the communication board using an RS-485 communication interface 123, as in the previous embodiment. A set of circuit breakers 124 connect line power at 120V AC to a set of 120V pool lighting fixtures. In this embodiment, up to 32 lighting fixtures may be controlled from system 120. As shown schematically in FIG. 7B, the communication board 125 is coupled to the lighting fixtures using a Power Line Carrier coupling 128, so that both power and signals are carried by the hot and neutral leads to each fixture.

The communications board 125 includes a microprocessor 127. As in the previous embodiment, the microprocessor has stored therein thermal management software; networking communication software; and the protocol for the PLC communications between the communication board and the lighting fixtures. As shown in FIGS. 12A and 12B, the controller 122 includes a display and keypad accessible by a user, so that software menus may be presented to the user (e.g. a list of available lightshow programs), and so that a user may devise new lightshow programs and input them.

A 120V AC system is preferable to a 12V AC system in some applications, since it is easier to install and may support more light fixtures than a similarly sized 12V system. However, a 12V system may be required in some localities because of safety concerns.

Figure 13:
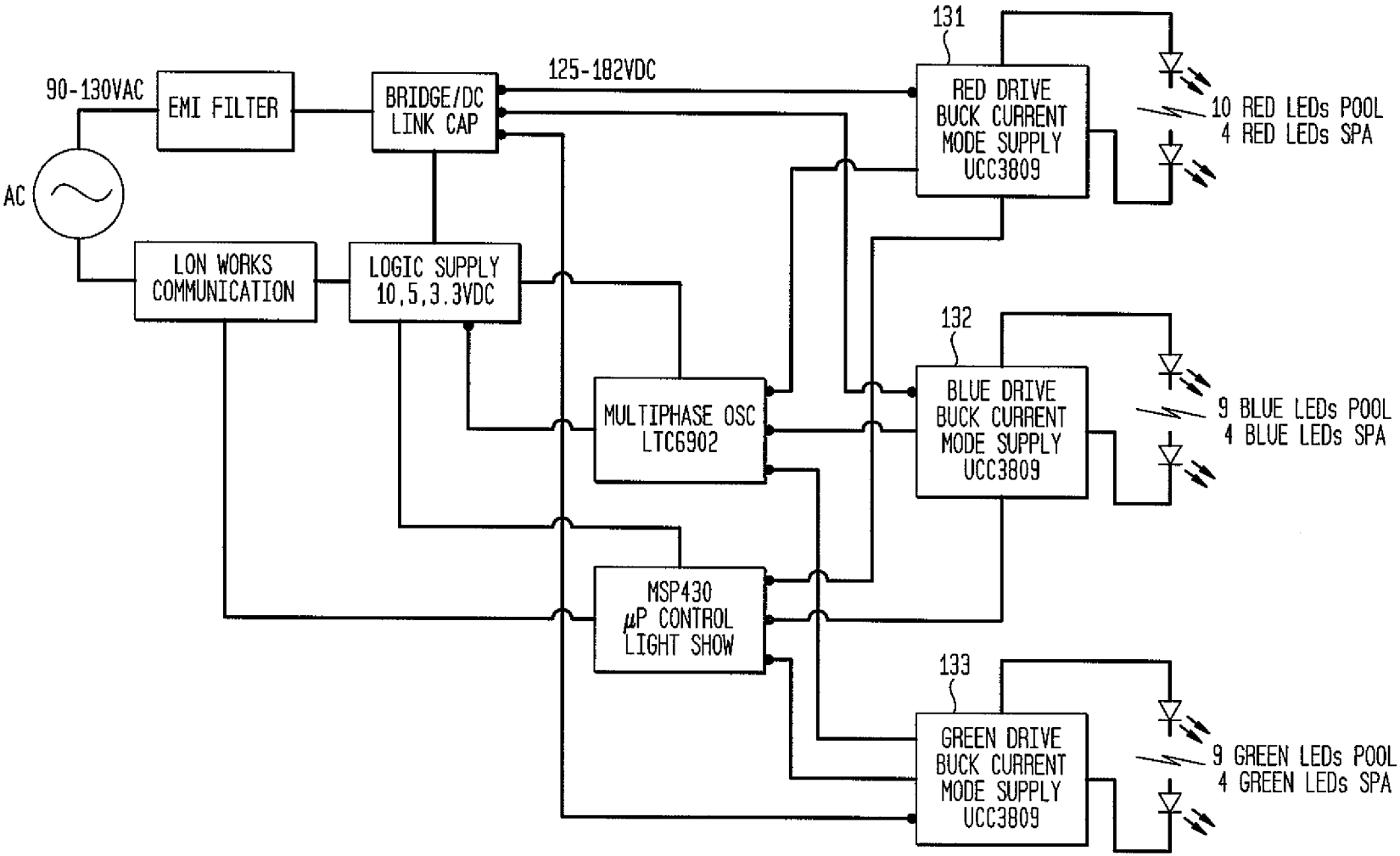
FIG. 13 is a block diagram of a 110/120V AC pool/spa lighting system using PLC technology, in accordance with an embodiment of the invention.

FIG. 13 is a schematic block diagram of a 110V AC pool/spa combination lighting system, according to another embodiment of the invention. The components and connections are similar to those shown in FIG. 9, except that the LED driver circuits 131, 132, 133 have buck converters instead of boost converters, for reducing the DC voltage (generally in the range of about 125V to 182V DC). Extra lighting fixtures may be controlled with this system in comparison with the system of FIG. 9 (e.g. 10 LEDs of each color for a pool, and an additional 4 LEDs of each color for a spa).

Figure 14A:
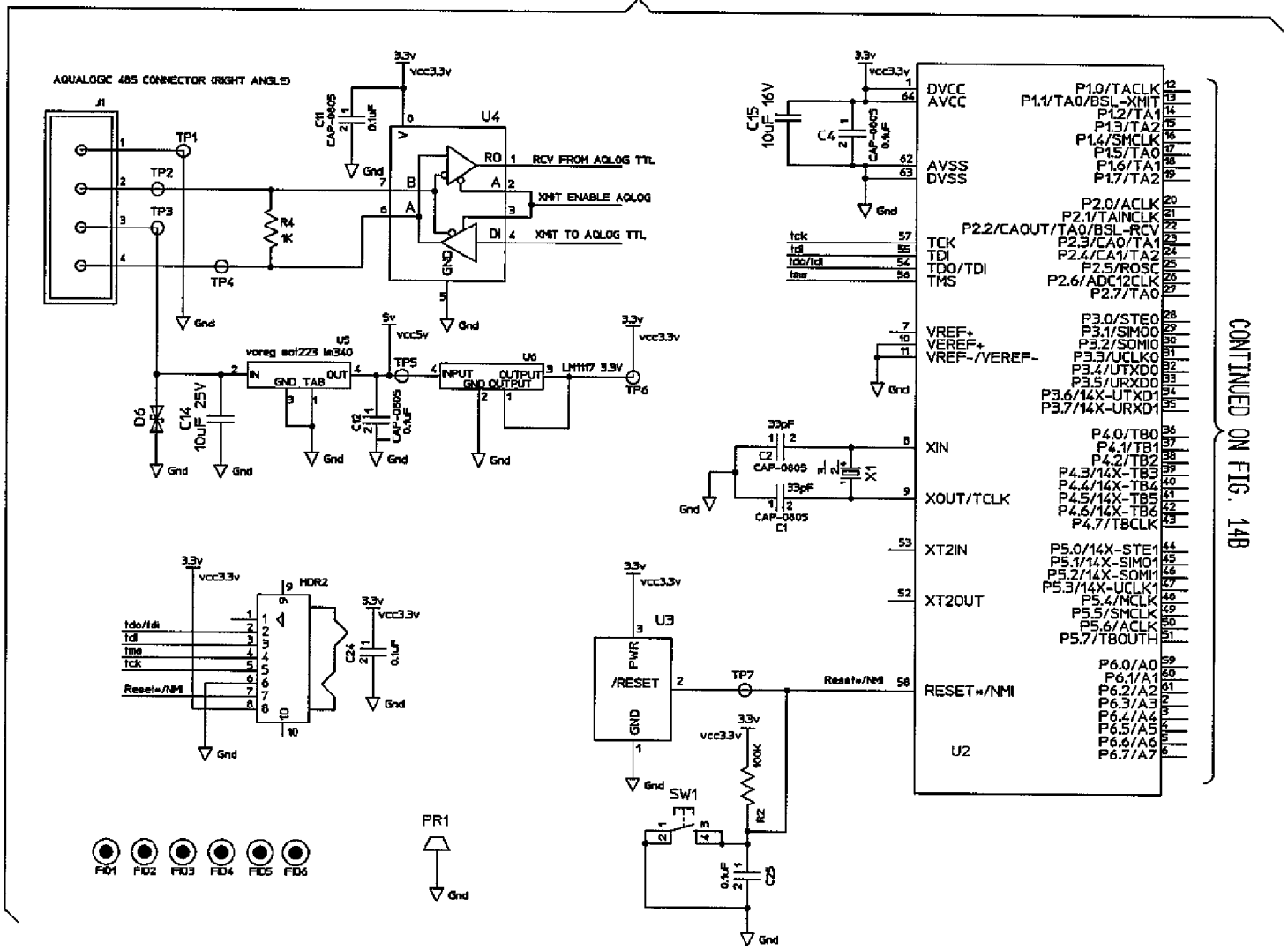

FIGS. 14A-14B show general schematic views of a communications board according to the present invention using an RS-485 communication interface, for use in the central controller. In this embodiment, communications with the lights is achieved using serial RS-485 wired connections between the lights and the controller. A Linear Technology LTC1535ISW isolated RS-485 transceiver could be used for this purpose, as shown in FIG. 14B. A similar communications board/circuit could be used in each lighting fixture.

Figure 15A:
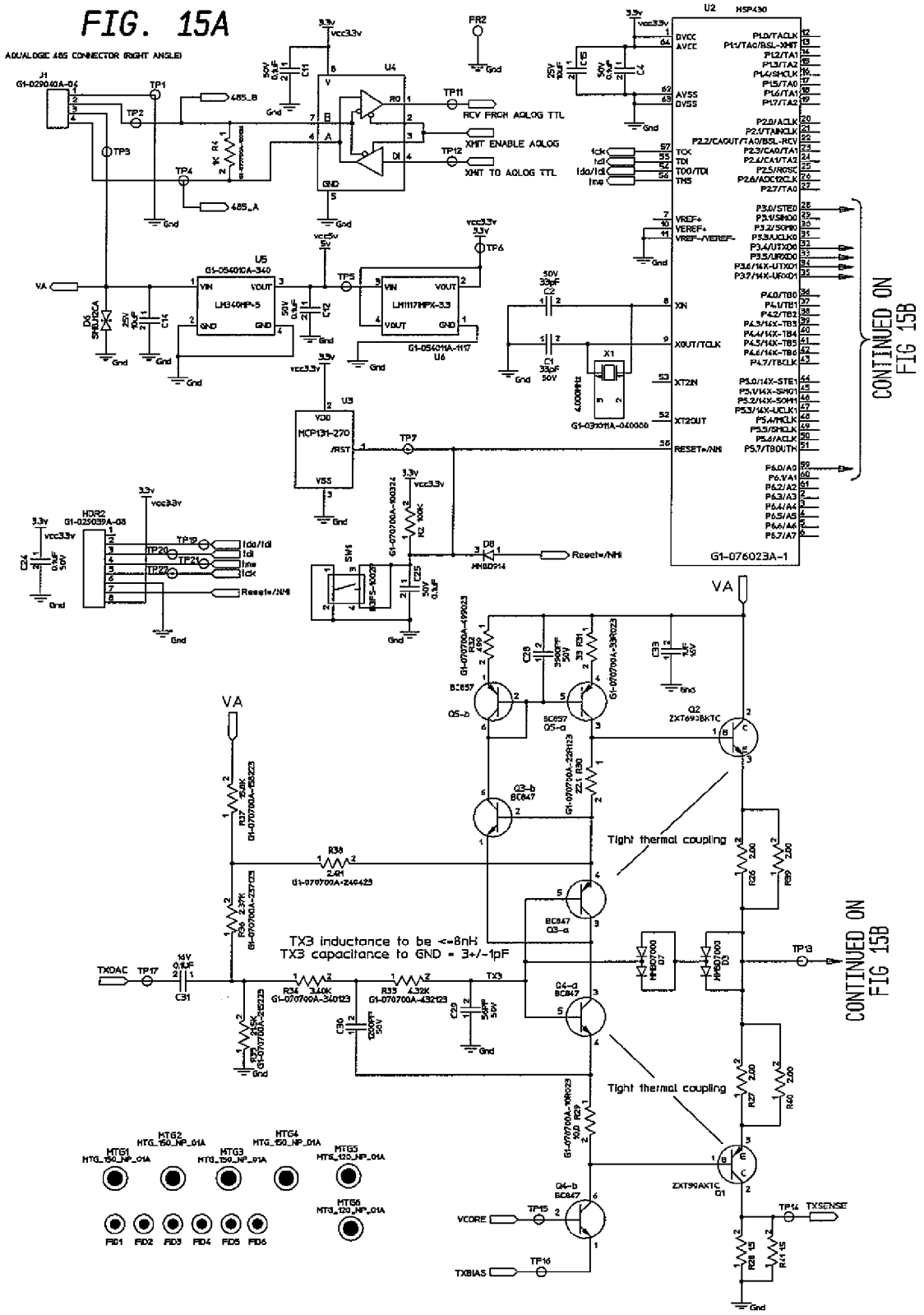
FIGS. 15A-15B are schematic circuit diagrams of a communications module using PLC technology and including a power line transceiver.
Figure 15B:
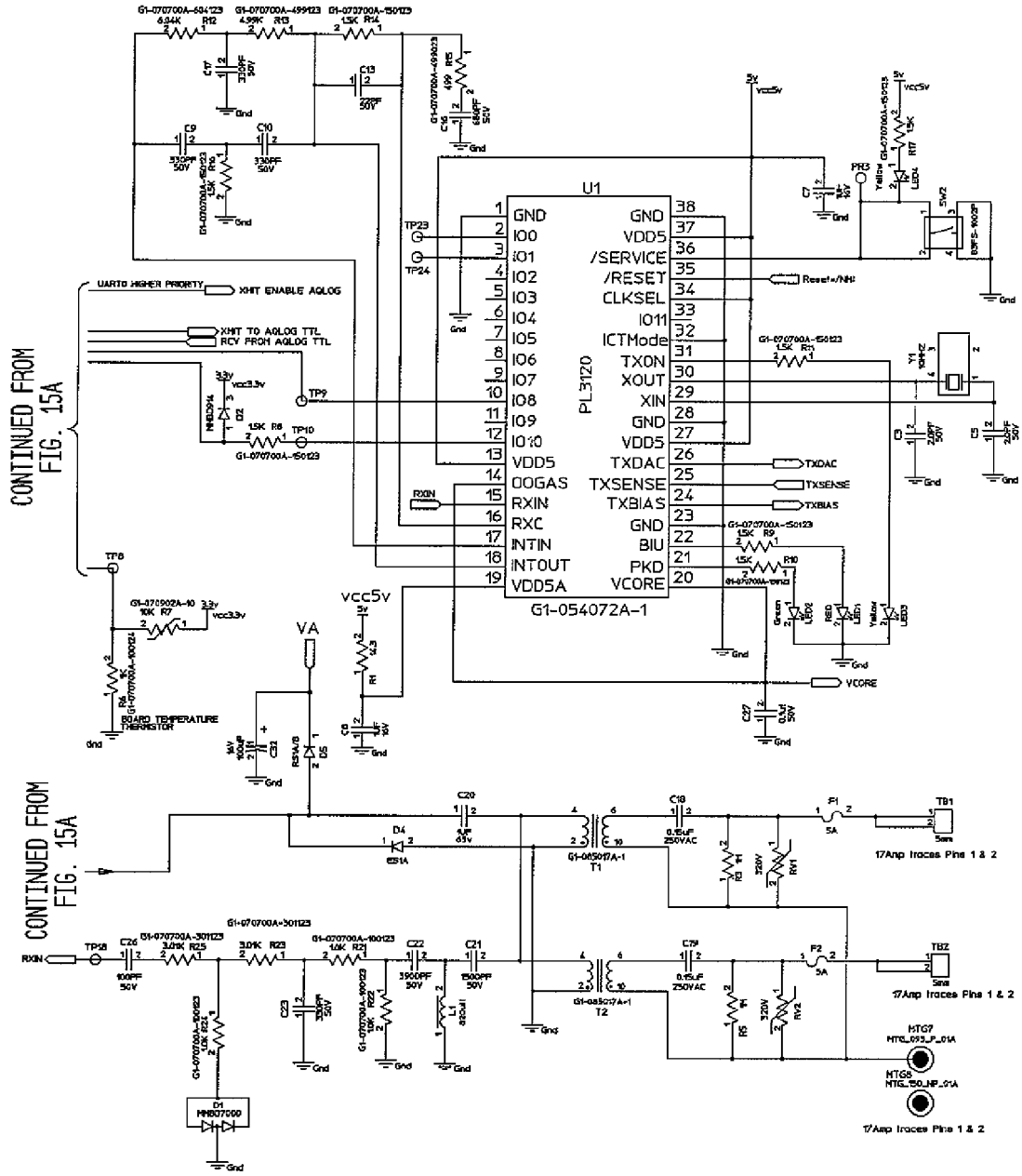

FIGS. 15A-15B show general schematic views of a communications board according to the present invention using PLC technology, for use in the central controller of the present invention. In this embodiment, communications with the lights is achieved using PLC communications over power lines interconnecting the controller and the lights. A PL3120 PLC transceiver chip, manufactured by Eschelon, Inc., could be used for this purpose. A similar communications board/circuit could be used in each lighting fixture.

Figure 17A:
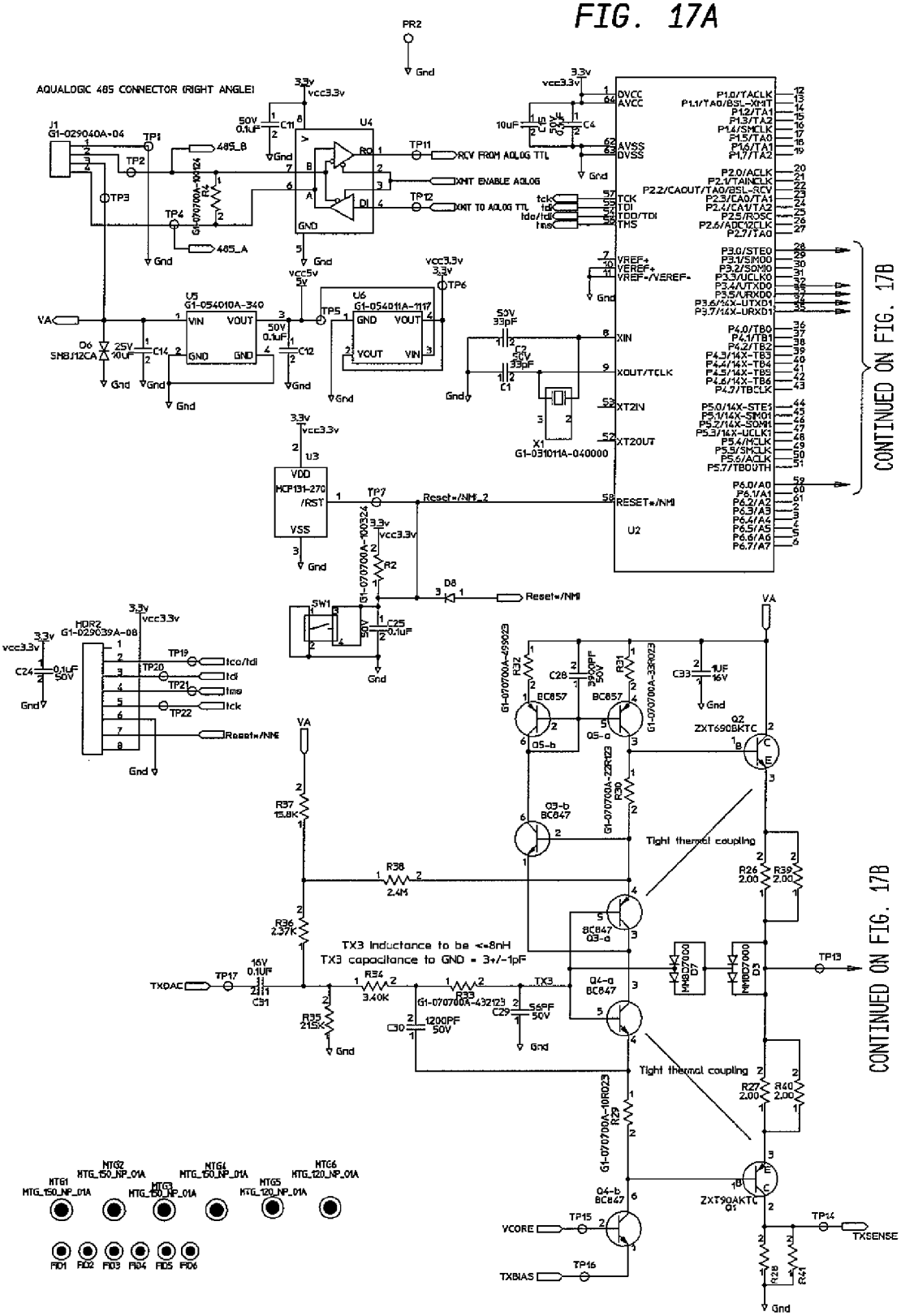
FIGS. 17A-17C are schematic circuit diagrams of a 12V communications module using PLC technology and including a power line transceiver.
Figure 17B:
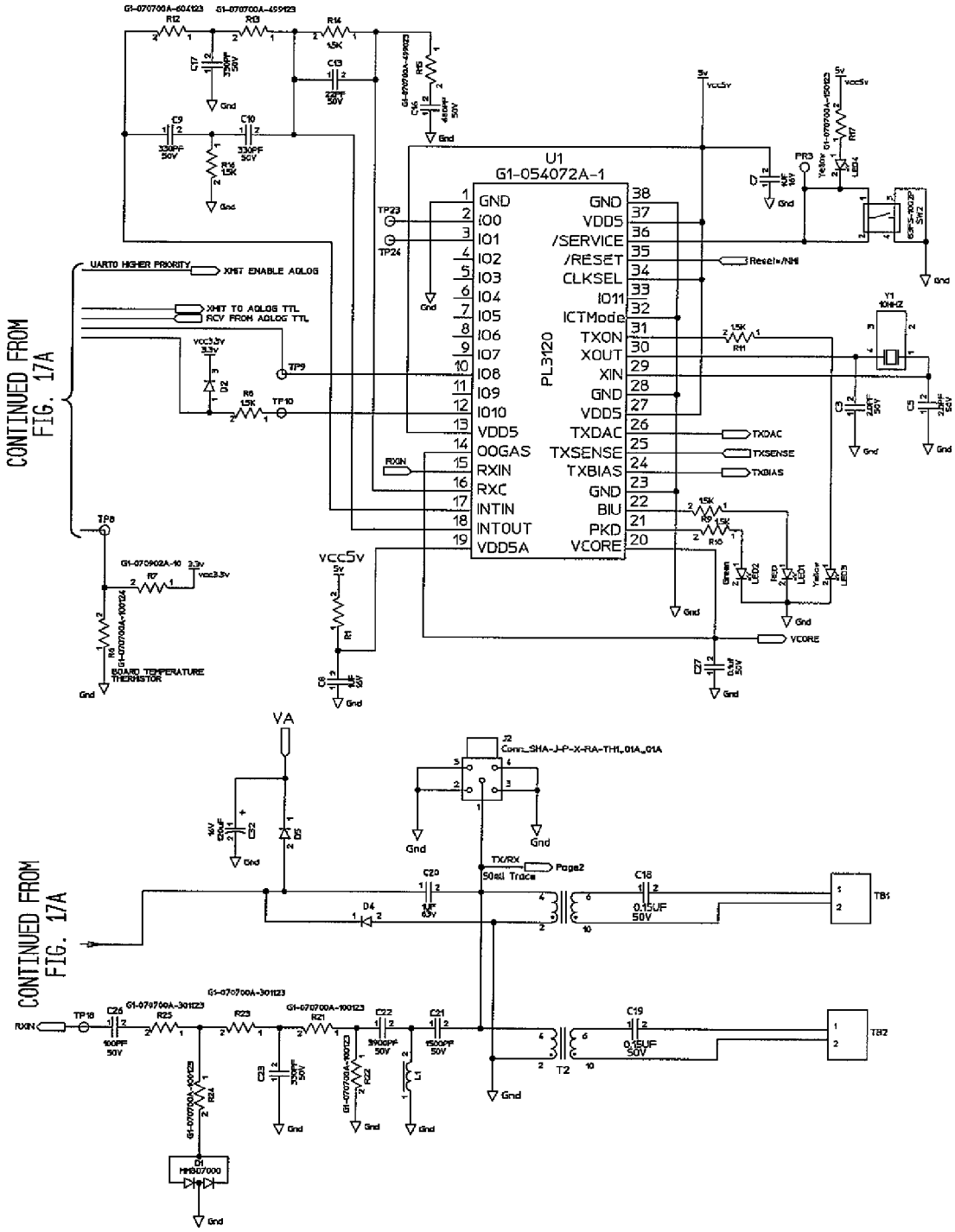
Figure 17C:
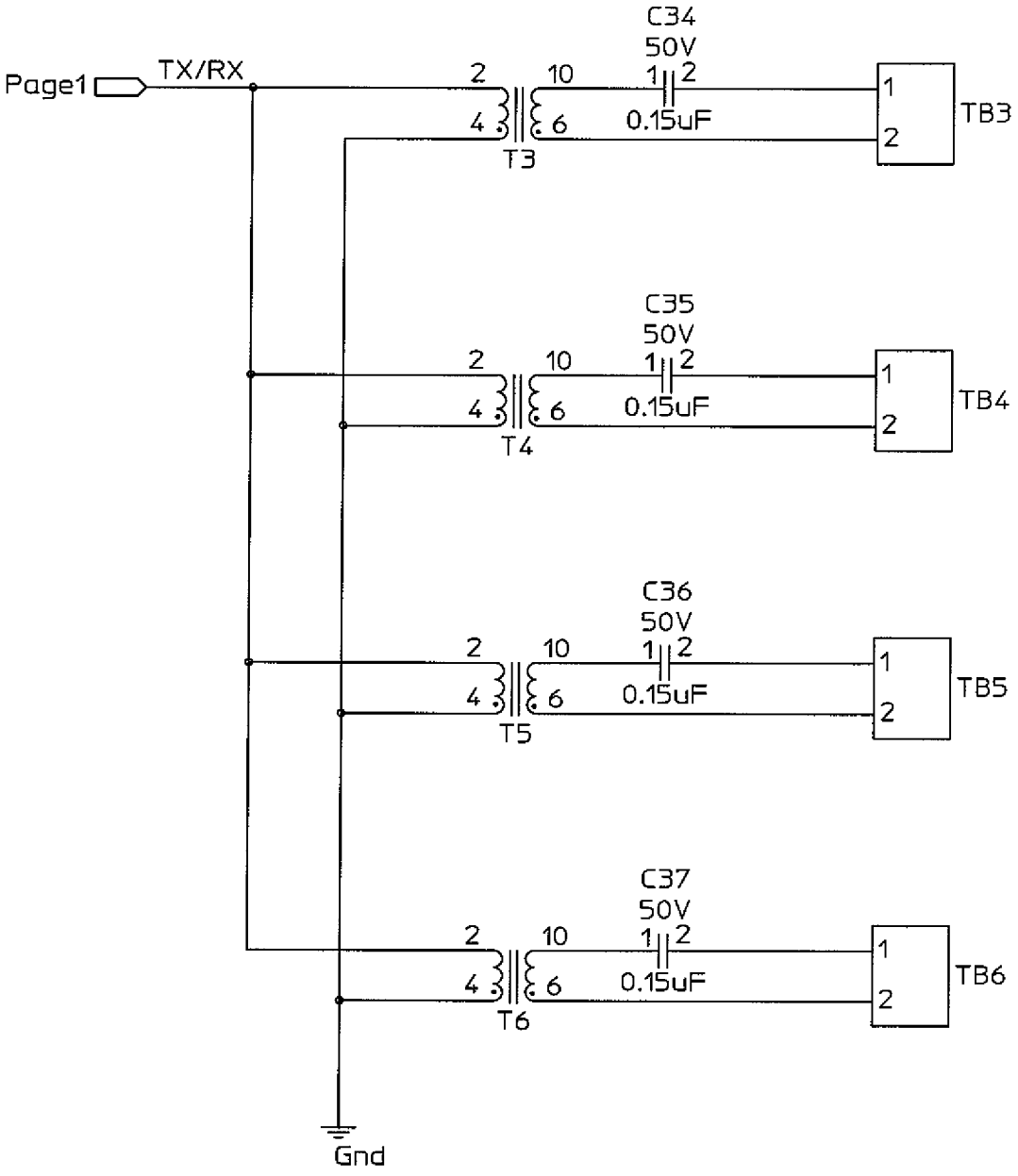

FIGS. 17A-17C show general schematic views of communications boards according to the present invention using low-voltage (e.g., 12V) PLC technology, for use in the central controller of the present invention. In this embodiment, communications with the lights is achieved using PLC communications over low-voltage power lines interconnecting the controller and the lights. A PL3120 PLC transceiver chip, manufactured by Eschelon, Inc., could be used for this purpose, with appropriate low-voltage transformers (see FIG. 17C). A similar communications board/circuit could be used in each lighting fixture.

Thermal Management of Lighting Fixtures

In a further embodiment of the invention, a thermal management system protects the LED lighting fixtures from overheating. A typical pool/spa lighting arrangement relies on water to keep lighting components of a luminaire (specifically, the circuit cards on which the light-emitting devices are mounted) within rated operating temperatures. Such components are susceptible to overheating if the luminaire is not submerged or partially submerged, unless the current delivered to them is interrupted.

In this embodiment of the invention, a thermal sensor shuts off the microprocessor of the lighting fixture if an abnormally high temperature is detected. In addition, surface mount thermistor components are installed on the LED mounting board, and a software algorithm is used to automatically reduce the LED intensity as needed to maintain safe operating temperatures. Thus, if the luminaire is dry, the LEDs will automatically be dimmed to the extent needed to prevent overheating of any components.

Figure 16:
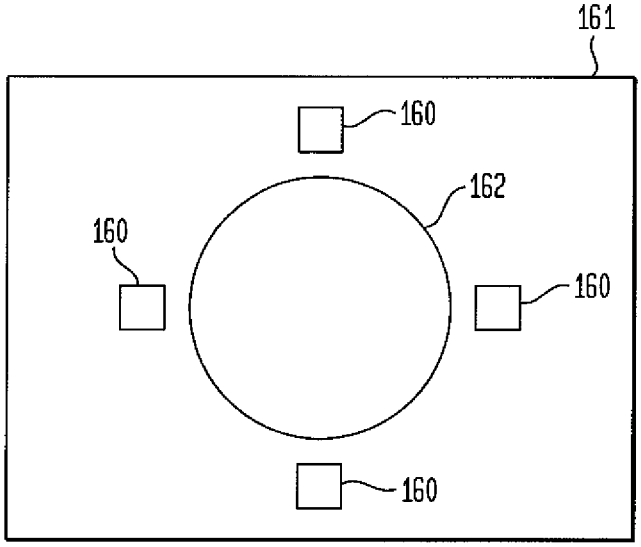
FIG. 16 is a schematic illustration of a thermal management system employing thermistors mounted on an LED circuit board, in accordance with another embodiment of the invention.

In an embodiment, four surface-mount thermistors 160 are mounted on the same circuit board 161 as the LEDs in each lighting fixture, as shown in FIG. 16. The thermistors are mounted at conveniently spaced locations at the edge of the area on the board where the LEDs are mounted. Thus, with the LEDs placed roughly in a circular area 162 in the center of the circuit board 161, the thermistors 160 may be at the 12, 3, 6, and 9 o'clock positions. The thermistors are connected to a bias circuit and to analog inputs of the microprocessor (e.g. microprocessor 77 in FIG. 7A). An analog to digital converter (ADC) samples the four thermistor inputs and assigns a numeric value to the measured voltage, so that the four measured voltages represent the temperature on the LED circuit board.

A software algorithm is executed whereby the four temperature readings are compared periodically (with a preset sampling interval), and the highest of the four readings is compared to a firmware threshold variable. If this highest reading is above the threshold, the algorithm causes the light output setting of all three LED channels (red/blue/green) to be reduced according to a proportion of the total output. This proportion (that is, the degree of reduction of the output setting) does not have a fixed value, but rather is computed based on excess temperature and the measured rate of temperature increase. If the temperature of an LED circuit board is rapidly rising, the reduction in the output setting will thus be more dramatic than if the temperature is rising slowly. If the temperature reading is only slightly above the threshold, the degree of reduction will be less than if the reading is substantially above the threshold.

At the next sampling interval, the algorithm is applied again. If the maximum of the four temperature readings remains above the threshold, the light output setting is reduced further. Conversely, if the maximum temperature reading is below the threshold, the light intensity may be proportionately increased.

The increase or decrease in the light output setting may be implemented by multiplying the computed proportion by the 'intensity' or 'brightness' user setting which is stored in memory. The original user setting is thus preserved, so that the output setting chosen by the user may be restored at a later time if the thermal management system temporarily reduces the light output.

A failsafe circuit may also be provided so that if there is any abnormal interruption in execution of the thermal management software, the luminaire will be shut off.

The above-describe thermal management system maintains the LED component temperatures within rated safe operating temperatures. If the temperature of a lighting fixture is non-uniform (e.g. a pool lighting fixture partially submerged), the system will nonetheless protect the components by managing the temperature based on the hottest thermistor. It is noteworthy that this system does not require any particular mounting orientation ("upright" or otherwise) for the luminaire.

It will be appreciated that a programmable lighting system as described above, in its various hardware and software embodiments, permits a user to adjust and control LED light displays; to adjust the speed at which color changes occur in a given light fixture; to use a pre-programmed light show, or to program a new show, and to alter the speed thereof; and to use all of these features with wet, dry or sporadic wet/dry fixtures or any combination thereof. Accordingly, the above-described embodiments offer significant advantages relative to the present state of the art.

It is noted that the present invention could include an authentication feature which allows the central controller, the communication board in the central controller, and each of the plurality of lights, to ascertain and verify the identities of associated hardware components. For example, the plurality of lights and the communication board could be programmed to bi-directionally communicate with each other so as to verify that only authorized communication boards and lights are being utilized. Similarly, the communication board and the central controller could be programmed to bi-directionally communication with each other so as to verify that only authorized communications boards and central controllers are being utilized.

Importantly, the user interface (e.g., display and keyboard) of the central controller of the present invention allows a user to create his or her own custom lighting program. This allows the user to specify desired colors from a palette or spectrum of colors, as well as to specify desired sequences, steps, effects, and/or motion parameters. The user can thus create his or her own customized lighting effect in a body of water.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention. What is desired to be protected by Letters Patent is set forth in the appended claims.

What is claimed is:

1. A programmable underwater lighting system, comprising:

an underwater lighting fixture for installation in a pool or spa, the underwater lighting fixture including a light source, a microprocessor in electrical communication with the light source, a memory having at least one stored control program executable by the microprocessor for controlling the light source, an alternating current (AC) power supply for supplying electrical power to the underwater lighting fixture, a logic power supply for supplying electrical power to the microprocessor, and a Power Line Carrier communications subsystem connected between the AC power supply and the logic power supply, and in electrical communication with the AC power supply, the logic power supply, and the microprocessor, and a central controller remote from and in communication with the underwater lighting fixture, the central controller allowing a user to specify a desired lighting sequence and transmitting an instruction to the underwater lighting fixture over a power line interconnecting the central controller and the underwater lighting fixture to selectively execute the stored control program to produce the desired lighting sequence, wherein the underwater lighting fixture receives the instruction from the central controller via the AC power supply using the Power Line Carrier communications subsystem and executes the instruction, and wherein prior to transmitting the instruction to the underwater lighting fixture the central controller authenticates the lighting fixture by communicating with the lighting fixture and determining whether the lighting fixture is authorized for use with the central controller.

2. The system of claim 1, wherein the central controller further comprises a Power Line Carrier communications subsystem for transmitting instructions to the underwater lighting fixture over a power line.

3. The system of claim 1, further comprising a remote control in wireless communication with the central controller for allowing a user to remotely control the underwater lighting fixture.

4. The system of claim 1, wherein the light source comprises a plurality of light-emitting diodes.

5. The system of claim 1, further comprising a plurality of lighting fixtures, each of the fixtures including a light source, a microprocessor in electrical communication with the light source, and a memory having at least one stored control program executable by the microprocessor for controlling the light source.

6. The system of claim 5, wherein at least one of the plurality of lighting fixtures is installed external to a pool or spa.

7. The system of claim 5, wherein the central controller transmits instructions to the plurality of lighting fixtures to selectively execute the stored control programs in the plurality of lighting fixtures to produce the desired lighting sequence.

8. The system of claim 7, wherein each of the instructions comprises a motion parameter for instructing the plurality of lighting fixtures to selectively execute the stored control programs to create a moving light sequence.

9. The system of claim 7, wherein each of the instructions comprises a speed parameter for controlling a speed of the desired lighting sequence.

10. The system of claim 7, wherein each of the instructions comprises a program selection parameter for selecting one of a plurality of stored control programs to be executed by a lighting fixture.

11. A programmable underwater lighting fixture, comprising:

a source of light;

a microprocessor in electrical communication with the source of light;

a memory in electrical communication with the microprocessor, the memory including a stored control program for controlling the source of light;

an alternating current (AC) power supply for supplying electrical power to the underwater lighting fixture;

a logic power supply for supplying electrical power to the microprocessor of the underwater lighting fixture; and a power line carrier transceiver connected between the AC power supply and the logic power supply, and in electrical communication with the AC power supply, the logic power supply, and the microprocessor for receiving instructions transmitted to the underwater lighting fixture through the AC power supply for remotely instructing the microprocessor to execute the stored control program to create a desired lighting effect, wherein prior to transmitting the instruction to the underwater lighting fixture a central controller authenticates the lighting fixture by communicating with the lighting fixture and determining whether the lighting fixture is authorized for use with the central controller.

12. The lighting fixture of claim 11, further comprising a plurality of lighting control programs stored in the memory.

13. The lighting fixture of claim 12, wherein the power line carrier transceiver receives a program selection instruction over a power line connected to the underwater lighting fixture and the microprocessor selects and executes one of the plurality of lighting control programs in response to the program selection instruction.

14. The lighting fixture of claim 11, wherein the source of light comprises a plurality of light-emitting diodes.

15. The lighting fixture of claim 11, further comprising a thermal fuse for interrupting power to the source of light if an abnormal temperature is detected.

16. The lighting fixture of claim 11, further comprising a thermistor in electrical communication with the microprocessor for detecting an operating temperature of the underwater lighting fixture.

17. The lighting fixture of claim 16, wherein the microprocessor dims the source of light to maintain a safe operating temperature for the underwater lighting fixture.

18. The lighting fixture of claim 16, wherein the microprocessor dims the source of light if the underwater lighting fixture is dry.

19. An underwater lighting fixture, comprising:

a circuit board;

a source of light mounted to the circuit board;

a microprocessor for controlling the source of light; and means mounted to the circuit board for detecting an operating temperature of the underwater lighting fixture, wherein said means are mounted at spaced locations peripherally about an area of the circuit board in which the source of light is mounted, and wherein if the operating temperature of the lighting fixture exceeds a predetermined temperature threshold, the microprocessor computes a proportion of the total output of the source of light that is based on an excess temperature between the operating temperature and the predetermined temperature threshold, and reduces output of the source of light according to the computed proportion.

20. The underwater lighting fixture of claim 19, wherein the means for detecting an operating temperature of the underwater lighting fixture comprises a plurality of thermistors positioned about the source of light.

21. The underwater lighting fixture of claim 20, wherein the microprocessor calculates a rate of temperature increase based upon temperature detected by the plurality of thermistors and proportionally decreases output of the source of light based upon the rate of temperature increase.

22. A method for illuminating a body of water, comprising:

providing a plurality of underwater lighting fixtures in the body of water, each of the plurality of underwater lighting fixtures including a source of light, a microprocessor in electrical communication with the source of light, a memory in communication with the microprocessor, the memory having at least one stored control program for controlling the light, an alternating current (AC) power supply for supplying electrical power to the underwater lighting fixture, a logic power supply for supplying electrical power to the microprocessor, and a Power Line Carrier communications subsystem interconnected between the AC power supply and the logic power supply and in electrical communication with the microprocessor;

interconnecting the plurality of underwater lighting fixtures with a central controller using power lines;

authenticating each of the plurality of underwater lighting fixtures prior to transmitting instructions to the plurality of underwater lighting fixtures by communicating with the lighting fixture and determining whether the lighting fixture is authorized for use with the central controller;

allowing a user to define a desired lighting effect for the body of water using the central controller; and transmitting instructions from the central controller to the plurality of underwater lighting fixtures through the power lines, the plurality of underwater lighting fixtures each receiving the instructions via the AC power supply using the Power Line Carrier communications subsystem and the instructions instructing the plurality of underwater lighting fixtures to selectively execute the at least one stored control program in each of the plurality of underwater lighting fixtures to create the desired lighting effect.

23. The method of claim 22, further comprising allowing the user to create a moving light sequence in the body of water using the central controller.

24. The method of claim 22, further comprising providing a remote control in communication with the central controller and allowing the user to remotely control the plurality of underwater lighting fixtures using the remote control.

25. An underwater lighting fixture, comprising:

a circuit board;

a source of light mounted to the circuit board;

a microprocessor for controlling the source of light; and means mounted to the circuit board for detecting an operating temperature of the underwater lighting fixture, the microprocessor determining whether the light is above or below a waterline and dimming the source of light according to whether the light is above or below the waterline, wherein said means are mounted at spaced locations peripherally about an area of the circuit board in which the source of light is mounted.

* * * * *